US011040798B2

(12) United States Patent
Walsh et al.

(10) Patent No.: US 11,040,798 B2
(45) Date of Patent: Jun. 22, 2021

(54) METHOD AND SYSTEM FOR FORMING PACKAGES

(71) Applicant: Graphic Packaging International, LLC, Atlanta, GA (US)

(72) Inventors: Joseph C. Walsh, Boulder, CO (US); Robert Lee Conatser, Golden, CO (US); Nicholas P. Lupfer, Lakewood, CO (US); William Allen Cox, West Bloomfield, MI (US)

(73) Assignee: Graphie Packaging International, LLC, Atlanta, GA (US)

( * ) Notice: Subject to any disclaimer, the term of this patent is extended or adjusted under 35 U.S.C. 154(b) by 183 days.

(21) Appl. No.: 16/055,498

(22) Filed: Aug. 6, 2018

(65) Prior Publication Data

US 2019/0047745 A1 Feb. 14, 2019

Related U.S. Application Data

(60) Provisional application No. 62/542,863, filed on Aug. 9, 2017.

(51) Int. Cl.
*B65D 5/60* (2006.01)
*B31B 50/72* (2017.01)
(Continued)

(52) U.S. Cl.
CPC ..... *B65D 5/606* (2013.01); *B31B 50/06* (2017.08); *B31B 50/102* (2017.08); *B31B 50/14* (2017.08);
(Continued)

(58) Field of Classification Search
CPC ..... B31B 2120/40; B31B 2105/0022; B31B 50/811; B31B 50/102; B31B 50/06; B31B 50/624; B31B 50/26
See application file for complete search history.

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

Supplementary European Search Report for EP 16 78 7209 dated Dec. 17, 2018.
(Continued)

*Primary Examiner* — Robert F Long
*Assistant Examiner* — Xavier A Madison
(74) *Attorney, Agent, or Firm* — Womble Bond Dickinson (US) LLP

(57) ABSTRACT

A system and method of at least partially forming reinforced packages. The method comprises moving a construct in a machine direction on a construct conveyor. The construct conveyor can comprise a primary lug belt with a primary lug, the construct can be disposed on the primary lug belt, and the moving the construct can comprise moving the primary lug belt in the machine direction to push the construct in the machine direction. The method further can comprise positioning a liner on the construct conveyor so that the liner at least partially extends over the construct and moving the liner in the machine direction on a secondary lug belt of the construct conveyor. The secondary lug belt can comprise a secondary lug and the moving the liner can comprise moving the secondary lug belt in the machine direction to push the liner in the machine direction.

29 Claims, 23 Drawing Sheets

(51) Int. Cl.

| | |
|---|---|
| ***B65D 33/02*** | (2006.01) |
| ***B31B 50/64*** | (2017.01) |
| ***B65D 65/14*** | (2006.01) |
| ***B31B 50/14*** | (2017.01) |
| ***B31B 50/81*** | (2017.01) |
| ***B31B 50/06*** | (2017.01) |
| ***B31B 50/10*** | (2017.01) |
| ***B31B 50/26*** | (2017.01) |
| *B31B 120/40* | (2017.01) |
| *B31B 110/10* | (2017.01) |
| *B31B 105/00* | (2017.01) |
| *B31B 120/30* | (2017.01) |

(52) U.S. Cl.

CPC ..... *B31B 50/26* (2017.08); *B31B 50/64* (2017.08); *B31B 50/811* (2017.08); *B65D 33/02* (2013.01); *B65D 65/14* (2013.01); *B31B 2105/0022* (2017.08); *B31B 2110/10* (2017.08); *B31B 2120/30* (2017.08); *B31B 2120/40* (2017.08)

(56) References Cited

U.S. PATENT DOCUMENTS

| | | | |
|---|---|---|---|
| 1,664,111 | A | 3/1928 | Johnson |
| 2,092,858 | A | 9/1937 | Richard |
| 2,095,910 | A | 10/1937 | Bergstein |
| 2,099,257 | A | 11/1937 | Bergstein |
| 2,107,946 | A | 2/1938 | Inman |
| 2,114,625 | A | 4/1938 | Bergstein |
| 2,134,057 | A | 10/1938 | Potdevin |
| 2,132,966 | A | 11/1938 | O'Brien |
| 2,166,388 | A | 7/1939 | Bergstein |
| 2,197,113 | A | 4/1940 | Piazze |
| 2,250,249 | A | 7/1941 | Bergstein |
| 2,273,470 | A | 2/1942 | Gardner |
| 2,282,207 | A | 5/1942 | Palmer |
| 2,286,465 | A | 6/1942 | Erlin |
| RE23,096 | E | 4/1949 | Mullinix |
| 2,502,117 | A | 3/1950 | Anderson |
| 2,553,923 | A | 5/1951 | Lambert |
| 2,758,520 | A | 8/1956 | Hepworth |
| 2,799,211 | A | 7/1957 | Zerlin |
| 2,835,435 | A | 5/1958 | Mullinix |
| 2,870,023 | A | 1/1959 | Vogt |
| 2,913,161 | A | 11/1959 | Travis |
| 2,987,402 | A | 6/1961 | Dold |
| 3,104,596 | A | 9/1963 | Bergstein |
| 3,105,417 | A | 10/1963 | Hammer |
| 3,142,231 | A | 7/1964 | Christensson |
| 3,142,430 | A | 7/1964 | Meyers |
| 3,153,991 | A | 10/1964 | Goodrich |
| 3,194,471 | A | 7/1965 | Murphy |
| 3,218,961 | A | 11/1965 | Kraft et al. |
| 3,240,419 | A | 3/1966 | Spiering et al. |
| 3,249,286 | A | 5/1966 | Palmer |
| 3,250,454 | A | 5/1966 | Steiger |
| 3,272,423 | A | 9/1966 | Bjarno |
| 3,324,998 | A | 6/1967 | Farquhar |
| 3,336,846 | A | 8/1967 | Berghgracht |
| 3,357,631 | A | 12/1967 | Aid et al. |
| 3,395,623 | A | 8/1968 | Baker |
| 3,399,818 | A | 9/1968 | Stegner |
| 3,412,925 | A | 11/1968 | Booth |
| 3,428,235 | A | 2/1969 | Randazzo |
| 3,459,357 | A | 8/1969 | Egger et al. |
| 3,461,642 | A | 8/1969 | Langen et al. |
| 3,482,758 | A | 12/1969 | Pierre |
| 3,515,333 | A | 6/1970 | Kotkas et al. |
| 3,543,469 | A | 12/1970 | Ullman |
| 3,552,640 | A | 1/1971 | Young |
| 3,554,434 | A | 1/1971 | Anderson |
| 3,570,751 | A | 3/1971 | Trewella |
| 3,575,409 | A | 4/1971 | Calvert |
| 3,576,290 | A | 4/1971 | Marchisen |
| 3,616,027 | A | 10/1971 | Honsel |
| 3,627,541 | A | 12/1971 | Farquhar |
| 3,637,130 | A | 1/1972 | Farquhar |
| 3,659,777 | A | 5/1972 | Kanada et al. |
| 3,739,545 | A | 6/1973 | Lattke |
| 3,800,677 | A | 4/1974 | Jones et al. |
| 3,878,771 | A | 4/1975 | Malcolm |
| RE28,554 | E | 9/1975 | Curler et al. |
| 3,945,870 | A | 3/1976 | Johnsen |
| 3,959,950 | A | 6/1976 | Fukuda |
| 3,964,669 | A | 6/1976 | Sontag et al. |
| 3,981,494 | A | 9/1976 | Prestegaard |
| 4,011,983 | A | 3/1977 | Greene |
| 4,034,658 | A | 7/1977 | Sherman |
| 4,082,216 | A | 4/1978 | Clarke |
| 4,164,171 | A | 8/1979 | Meyers et al. |
| 4,170,928 | A | 10/1979 | Beasley |
| 4,196,035 | A | 4/1980 | Reil |
| 4,228,945 | A | 10/1980 | Wysocki |
| 4,244,281 | A | 1/1981 | Kauffman et al. |
| 4,267,955 | A | 5/1981 | Struble |
| 4,284,205 | A | 8/1981 | Hirata |
| 4,312,451 | A | 1/1982 | Forbes, Jr. |
| 4,313,542 | A | 2/1982 | Roberts et al. |
| 4,331,434 | A | 5/1982 | Buschor |
| 4,359,214 | A | 11/1982 | Eldridge |
| 4,398,636 | A | 8/1983 | Baxter |
| 4,457,483 | A | 7/1984 | Gagne |
| 4,477,014 | A | 10/1984 | Brandenburger |
| 4,478,351 | A | 10/1984 | Homma |
| 4,484,683 | A | 11/1984 | Werner, Jr. |
| 4,490,960 | A | 1/1985 | Klemesrud |
| 4,494,785 | A | 1/1985 | Song |
| 4,520,615 | A | 6/1985 | Engler |
| 4,575,000 | A | 3/1986 | Gordon et al. |
| 4,577,746 | A | 3/1986 | Tokuno et al. |
| 4,578,929 | A | 4/1986 | Tisma |
| 4,582,315 | A | 4/1986 | Scarpa et al. |
| 4,600,346 | A | 7/1986 | Podosek |
| 4,605,464 | A | 8/1986 | Slevin |
| 4,608,259 | A | 8/1986 | Cortopassi |
| 4,627,223 | A | 12/1986 | Janhonen |
| 4,726,170 | A | 2/1988 | Sawa et al. |
| 4,747,703 | A | 5/1988 | Cazes |
| 4,754,914 | A | 7/1988 | Wischusen, III |
| 4,775,771 | A | 10/1988 | Pawlowski |
| 4,785,696 | A | 11/1988 | Martiny |
| 4,793,117 | A | 12/1988 | Raudat et al. |
| 4,802,664 | A | 2/1989 | Larsen |
| 4,854,983 | A | 8/1989 | Bryniarski et al. |
| 4,865,921 | A | 9/1989 | Hollenberg |
| 4,881,934 | A | 11/1989 | Harston et al. |
| 4,890,439 | A | 1/1990 | Smart |
| 4,919,785 | A | 4/1990 | Willey et al. |
| 4,930,639 | A | 6/1990 | Rigby |
| 4,936,935 | A | 6/1990 | Beckett |
| 4,940,200 | A | 7/1990 | Sawyer |
| 4,963,424 | A | 10/1990 | Beckett |
| 4,986,522 | A | 1/1991 | Paulson |
| 4,995,217 | A | 2/1991 | Francis, Jr. |
| 5,014,582 | A | 5/1991 | Teik |
| 5,019,029 | A | 5/1991 | Calvert |
| 5,028,147 | A | 7/1991 | Graham |
| 5,034,234 | A | 7/1991 | Andreas et al. |
| 5,071,062 | A | 12/1991 | Bradley et al. |
| 5,078,273 | A | 1/1992 | Kuchenbecker |
| 5,080,643 | A | 1/1992 | Mitchell et al. |
| 5,093,364 | A | 3/1992 | Richards |
| 5,096,723 | A | 3/1992 | Turpin |
| 5,097,651 | A * | 3/1992 | Decottignies ..... B65D 33/02 53/451 |
| 5,102,385 | A | 4/1992 | Calved |
| 5,102,485 | A | 4/1992 | Keeler et al. |
| 5,108,355 | A | 4/1992 | Walsh |
| 5,117,078 | A | 5/1992 | Beckett |
| 5,132,124 | A | 7/1992 | Tamaki et al. |
| 5,154,041 | A | 10/1992 | Schneider |

(56) References Cited

U.S. PATENT DOCUMENTS 5,175,404 A 12/1992 Andreas et al.
5,176,612 A 1/1993 Calvert et al.
5,199,792 A 4/1993 Roosa
5,205,651 A * 4/1993 Decottignies ..... B65D 33/02 229/87.01
5,207,629 A * 5/1993 Walsh ..... B31B 50/00 198/403
5,213,902 A 5/1993 Beckett
5,221,419 A 6/1993 Beckett
5,224,919 A * 7/1993 Walsh ..... B31B 50/00 493/110
5,242,365 A 9/1993 Counts
5,254,071 A 10/1993 Laroche
5,260,537 A 11/1993 Beckett
5,266,386 A 11/1993 Beckett
5,282,349 A 2/1994 Siegel
5,282,528 A 2/1994 Hudson
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,632,368 A 5/1997 Moncrief
5,653,671 A 8/1997 Reuteler
5,657,610 A 8/1997 Dietrich et al.
5,662,577 A 9/1997 Reuteler
5,672,407 A 9/1997 Beckett
5,688,427 A 11/1997 Gallo, Jr.
5,746,871 A 5/1998 Walsh
5,759,422 A 6/1998 Schmelzer
5,772,569 A 6/1998 Janhonen
5,800,724 A 9/1998 Habeger
5,845,769 A 12/1998 Yeager
5,876,319 A 3/1999 Holton
5,921,681 A 7/1999 Money
5,938,110 A 8/1999 Bernstein
5,964,161 A 10/1999 Conway
5,997,458 A 12/1999 Guttinger et al.
6,050,063 A 4/2000 Ford et al.
6,063,415 A 5/2000 Walters
6,073,423 A 6/2000 House
6,082,613 A 7/2000 Mikulski et al.
6,114,679 A 9/2000 Lai
6,132,351 A 10/2000 Lotto et al.
6,139,662 A 10/2000 Forman
6,146,028 A 11/2000 Preszler
6,150,646 A 11/2000 Lai et al.
6,204,492 B1 3/2001 Zeng et al.
6,206,279 B1 3/2001 Countee
6,213,286 B1 4/2001 Hunter et al.
6,234,384 B1 5/2001 Capy et al.
6,251,451 B1 6/2001 Zeng
6,254,519 B1 7/2001 Toshima
6,311,457 B1 11/2001 May et al.
6,312,742 B1 11/2001 Wood et al.
6,332,488 B1 12/2001 Walsh
6,335,042 B1 1/2002 Money
6,349,874 B1 2/2002 Hill
6,360,941 B1 3/2002 Larsson
6,398,010 B1 6/2002 Fangmeier
6,401,927 B1 6/2002 Sorensen et al.
6,414,290 B1 7/2002 Cole
6,425,847 B1 7/2002 Broenstrup
6,431,365 B1 8/2002 Money
6,433,322 B2 8/2002 Zeng et al.
6,455,827 B2 9/2002 Zeng
6,490,843 B1 12/2002 May
6,494,619 B1 12/2002 Sulpizio
6,509,052 B1 1/2003 Benham et al.
6,550,608 B1 4/2003 Brown et al.
6,552,315 B2 4/2003 Zeng et al.
6,635,139 B2 10/2003 Bohn
6,637,646 B1 10/2003 Muise
6,657,165 B1 12/2003 Makutonin
6,676,583 B2 1/2004 Walsh
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,854,639 B2 2/2005 Walsh
6,869,387 B2 3/2005 Post et al.
6,915,829 B2 7/2005 Popp
6,948,293 B1 9/2005 Eckermann
6,986,920 B2 1/2006 Forman et al.
6,993,889 B2 2/2006 Ford et al.
7,019,271 B2 3/2006 Wnek et al.
7,070,551 B2 7/2006 Lasson
7,143,930 B2 12/2006 Money et al.
7,414,230 B2 8/2008 Fitzwater
7,445,590 B2 11/2008 Selle et al.
7,461,838 B2 12/2008 Hendricks et al.
7,473,875 B2 1/2009 Fitzwater
7,509,789 B2 3/2009 Scholtes et al.
7,510,515 B2 3/2009 Ichikawa
7,604,155 B2 10/2009 Bossel et al.
7,667,167 B2 2/2010 Fitzwater
7,695,421 B2 4/2010 Ford
7,699,214 B2 4/2010 Mestre et al.
7,794,147 B2 9/2010 Perelman
7,819,583 B2 10/2010 Walker et al.
7,837,606 B2 11/2010 Tetenborg et al.
7,893,389 B2 2/2011 Fitzwater
7,913,897 B2 3/2011 Manaige
7,935,041 B2 5/2011 Graham et al.
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,024,910 B2 9/2011 Graham et al.
8,025,618 B2 9/2011 Walsh et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,323,165 B2 12/2012 Atoui
8,403,819 B2 3/2013 Zoeckler
8,403,820 B2 3/2013 Zoeckler
8,468,782 B2 6/2013 Michalsky et al.
8,474,163 B2 7/2013 Rubin
8,479,972 B2 7/2013 Craft
8,500,330 B2 8/2013 Nomura et al.
8,579,780 B2 11/2013 Senbo
8,672,214 B2 3/2014 Manaige
8,727,204 B2 5/2014 Burke
8,826,959 B2 9/2014 Files et al.
8,870,519 B2 10/2014 Karst
8,961,380 B2 2/2015 Langen
9,050,770 B1 6/2015 Russell
9,073,659 B2 7/2015 Smith
9,108,761 B2 8/2015 Fitzwater et al.
9,113,648 B2 8/2015 Burke
9,156,579 B2 10/2015 Pinkstone
9,156,582 B2 10/2015 Walsh et al.
9,238,343 B2 1/2016 Selle et al.

(56) References Cited

U.S. PATENT DOCUMENTS

| | | | | |
|---|---|---|---|---|
| 9,346,234 | B2 | 5/2016 | Hajek et al. | |
| 9,346,582 | B2 | 5/2016 | Pinkstone | |
| 9,463,896 | B2 | 10/2016 | Fitzwater | |
| 9,522,499 | B2 | 12/2016 | Files et al. | |
| 9,663,320 | B2 | 5/2017 | Wittmann et al. | |
| 9,758,275 | B2 | 9/2017 | Fitzwater et al. | |
| 10,023,349 | B2 | 7/2018 | Fitzwater | |
| 10,173,805 | B2 | 1/2019 | Waddington | |
| 10,737,824 | B2 | 8/2020 | Fitzwater | |
| 2002/0041067 | A1 | 4/2002 | Muller | |
| 2002/0148882 | A1 | 10/2002 | Bowers | |
| 2003/0002755 | A1 | 1/2003 | Kim et al. | |
| 2003/0080120 | A1 | 5/2003 | Whitmore et al. | |
| 2003/0144121 | A1 | 7/2003 | Walsh | |
| 2003/0185948 | A1 | 10/2003 | Garwood | |
| 2003/0197051 | A1 | 10/2003 | Muise | |
| 2003/0206997 | A1 | 11/2003 | Winkelman et al. | |
| 2004/0004111 | A1 | 1/2004 | Cardinale | |
| 2004/0016216 | A1 | 1/2004 | Romagnoli | |
| 2004/0074947 | A1 | 4/2004 | Hillebrand | |
| 2004/0101605 | A1 | 5/2004 | Sigel | |
| 2004/0206049 | A1 | 10/2004 | Hiramoto et al. | |
| 2005/0014623 | A1 | 1/2005 | Van De Kruys | |
| 2005/0124478 | A1 | 6/2005 | Scholtes et al. | |
| 2005/0272583 | A1 | 12/2005 | Totani | |
| 2005/0284865 | A1 | 12/2005 | Fogle et al. | |
| 2006/0009339 | A1 | 1/2006 | Sleight et al. | |
| 2006/0027303 | A1 | 2/2006 | Hunter | |
| 2006/0037290 | A1 | 2/2006 | Smith | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0067225 | A1 | 3/2008 | Moore | |
| 2008/0227612 | A1 | 9/2008 | Harston | |
| 2008/0308614 | A1 | 12/2008 | Fitzwater | |
| 2009/0005228 | A1 | 1/2009 | Goto et al. | |
| 2009/0039077 | A1 | 2/2009 | Fitzwater | |
| 2009/0139187 | A1 | 6/2009 | Wood | |
| 2009/0193757 | A1 | 8/2009 | Roesler | |
| 2009/0197750 | A1 | 8/2009 | Beckmann | |
| 2009/0214142 | A1 | 8/2009 | Bossel et al. | |
| 2009/0252440 | A1 | 10/2009 | Biese | |
| 2010/0022375 | A1 | 1/2010 | Colla | |
| 2010/0046861 | A1 | 2/2010 | Wilcoxen | |
| 2010/0066007 | A1 | 3/2010 | Muller | |
| 2010/0263332 | A1 | 10/2010 | Files et al. | |
| 2010/0284634 | A1 | 11/2010 | Hadley | |
| 2011/0017812 | A1 | 1/2011 | Belko et al. | |
| 2011/0019942 | A1 | 1/2011 | Piraneo | |
| 2011/0052106 | A1 | 3/2011 | Holmes et al. | |
| 2011/0053746 | A1* | 3/2011 | Desertot | B31D 1/005 493/102 |
| 2011/0255809 | A1 | 10/2011 | Tucker et al. | |
| 2011/0297680 | A1 | 12/2011 | Howell et al. | |
| 2012/0224794 | A1 | 9/2012 | Veder | |
| 2012/0231941 | A1 | 9/2012 | Senbo | |
| 2012/0267425 | A1 | 10/2012 | Whiteside | |
| 2012/0297736 | A1 | 11/2012 | Ausnit | |
| 2013/0068653 | A1 | 3/2013 | Lipinski | |
| 2013/0202229 | A1 | 8/2013 | Broering | |
| 2014/0016882 | A1 | 1/2014 | Fitzwater | |
| 2014/0045666 | A1 | 2/2014 | Endou et al. | |
| 2014/0113787 | A1 | 4/2014 | Aganovic et al. | |
| 2014/0128235 | A1 | 5/2014 | Walsh et al. | |
| 2014/0270592 | A1 | 9/2014 | Walsh | |
| 2015/0048152 | A1 | 2/2015 | Vistrom | |
| 2015/0072848 | A1 | 3/2015 | Graham et al. | |
| 2015/0083789 | A1 | 3/2015 | Fitzwater et al. | |
| 2015/0367974 | A1 | 12/2015 | Sytema | |
| 2016/0107814 | A1 | 4/2016 | Fitzwater | |
| 2016/0185065 | A1 | 6/2016 | Sytema | |
| 2016/0318274 | A1 | 11/2016 | Walsh | |
| 2016/0318275 | A1 | 11/2016 | Walsh | |
| 2016/0368205 | A1 | 12/2016 | Wieduwilt et al. | |
| 2017/0015079 | A1* | 1/2017 | Walsh | B65D 5/606 |
| 2018/0086018 | A1 | 3/2018 | Fukuda | |
| 2018/0339480 | A1 | 11/2018 | Yanagisawa | |
| 2019/0143625 | A1 | 5/2019 | Lau | |

FOREIGN PATENT DOCUMENTS

| | | | |
|---|---|---|---|
| CN | 101102887 | A | 1/2008 |
| CN | 103434294 | A | 12/2013 |
| DE | 1 060 313 | | 6/1959 |
| DE | 11 47 379 | B | 4/1963 |
| DE | 18 10 965 | A1 | 10/1970 |
| DE | 203 00 817 | | 4/2003 |
| EP | 0 729 828 | A2 | 9/1996 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 353 843 | B1 | 4/2005 |
| EP | 1 798 159 | A1 | 6/2007 |
| EP | 1 964 785 | | 9/2008 |
| EP | 2 487 027 | | 8/2012 |
| EP | 2 492 203 | | 8/2012 |
| EP | 2 492 204 | | 8/2012 |
| EP | 2 748 078 | B1 | 10/2016 |
| EP | 2 505 347 | B1 | 12/2016 |
| FR | 1 048 714 | A | 12/1953 |
| FR | 2 516 481 | | 5/1983 |
| FR | 2 665 882 | | 2/1992 |
| FR | 2 687 384 | | 8/1993 |
| GB | 632554 | | 11/1949 |
| GB | 2 351 035 | A | 12/2000 |
| GB | 2 365 000 | | 2/2002 |
| JP | S61-232175 | | 10/1986 |
| JP | 62-16319 | | 1/1987 |
| JP | S63-502418 | | 9/1988 |
| JP | 5-28626 | | 4/1993 |
| JP | 5-147664 | | 6/1993 |
| JP | 2004 224402 | | 8/2004 |
| JP | 2005-320022 | A | 11/2005 |
| JP | 2006-240671 | A | 9/2006 |
| JP | 2008-105707 | A | 5/2008 |
| JP | 2011-168330 | | 9/2011 |
| JP | 2011-168331 | | 9/2011 |
| JP | 2011-173640 | | 9/2011 |
| JP | 2011-189978 | A | 9/2011 |
| JP | 2010-222050 | | 10/2011 |
| JP | 2011-251774 | A | 12/2011 |
| JP | 2012-51579 | | 3/2012 |
| JP | 2012-152901 | | 8/2012 |
| JP | 2012-187899 | | 10/2012 |
| JP | 2012-533487 | | 12/2012 |
| JP | 2018-039167 | A | 3/2018 |
| NL | 87 840 | C | 11/1957 |
| WO | WO 87/03249 | | 6/1987 |
| WO | WO 2006/052326 | | 5/2006 |
| WO | WO 2007/067705 | | 6/2007 |
| WO | WO 2007/084525 | A2 | 7/2007 |
| WO | WO 2008/086277 | | 7/2008 |
| WO | WO 2009/023286 | | 2/2009 |
| WO | WO 2011/011283 | A2 | 1/2011 |
| WO | WO 2011/031545 | A2 | 3/2011 |
| WO | WO 2011/040994 | A1 | 4/2011 |
| WO | WO 2013/003149 | A1 | 1/2013 |
| WO | WO 2013/117983 | A2 | 8/2013 |
| WO | WO 2014/070232 | A1 | 5/2014 |

(56) References Cited

FOREIGN PATENT DOCUMENTS

| | | | |
|---|---|---|---|
| WO | WO 2015/028825 | A1 | 3/2015 |
| WO | WO 2016/176540 | A1 | 11/2016 |

OTHER PUBLICATIONS

Supplementary European Search Report for EP 16 82 5077 dated Mar. 4, 2019.
International Search Report and Written Opinion for PCT/US2016/029989 dated Aug. 16, 2016.
International Search Report and Written Opinion for PCT/US2016/030046 dated Aug. 19, 2016.
Office Action for Canadian Application No. 2,980,354 dated Oct. 1, 2018.
International Search Report and Written Opinion for PCT/US2016/042010 dated Oct. 12, 2016.
International Search Report and Written Opinion for PCT/US2016/047521 dated Dec. 13, 2016.
Supplementary Partial European Search Report for EP 14 84 9557 dated Mar. 7, 2017.
International Search Report and Written Opinion for PCT/US2016/043520 dated Oct. 28, 2016.
International Search Report and Written Opinion for PCT/US2014/057385 dated Jan. 30, 2015.
Office Action for Chinese Application No. 201680024662.X dated Nov. 1, 2018, with English translation.
Supplementary European Search Report for EP 14 84 9557 dated Jun. 7, 2017.
Supplementary European Search Report for EP 16 78 7218 dated Jan. 28, 2019.
Notification of the First Office Action for Chinese Application No. 201680041116.7 dated Jan. 4, 2019, with English translation.
Notice of Reasons for Refusal for Japanese Application No. 2018-501343 dated Jul. 6, 2020, with English translation.
Notice of Reasons for Refusal for Japanese Application No. 2018-501343 dated Oct. 28, 2019, with English translation.
International Search Report and Written Opinion for PCT/US2018/045338 dated Nov. 29, 2018.
International Search Report and Written Opinion for PCT/US2019/040772 dated Oct. 24, 2019.

* cited by examiner

METHOD AND SYSTEM FOR FORMING PACKAGES

CROSS-REFERENCE TO RELATED APPLICATIONS

This application claims the benefit of U.S. Provisional Patent Application No. 62/542,863, filed on Aug. 9, 2017.

INCORPORATION BY REFERENCE

The disclosures of U.S. Provisional Patent Application No. 62/542,863, filed on Aug. 9, 2017, U.S. Provisional Patent Application No. 62/231,723, filed Jul. 14, 2015, U.S. Provisional Patent Application No. 62/179,172, filed Apr. 29, 2014, and U.S. Provisional Patent Application No. 62/179,480, filed May 8, 2015, U.S. patent application Ser. No. 14/496,252, filed Sep. 25, 2014, U.S. patent application Ser. No. 15/142,103, filed Apr. 29, 2016, U.S. patent application Ser. No. 15/142,435, filed Apr. 29, 2016, and U.S. patent application Ser. No. 15/209,013, filed Jul. 13, 2016, are hereby incorporated by reference as if presented herein in their entirety and are incorporated by reference for all purposes.

BACKGROUND OF THE DISCLOSURE

The present disclosure generally relates to reinforced packages for holding products and to methods of at least partially forming the packages. More specifically, the present disclosure is directed to methods and systems for at least partially forming the packages including a bag or liner having a sealed bottom portion and sealed side portions, the bag or liner being attached to a carton or blank.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In general, one aspect of the disclosure is directed to a method of at least partially forming reinforced packages. The method comprises moving a construct in a machine direction on a construct conveyor. The construct conveyor can comprise a primary lug belt with a primary lug, the construct can be disposed on the primary lug belt, and the moving the construct can comprise moving the primary lug belt in the machine direction so that the primary lug pushes the construct in the machine direction. The method further can comprise positioning a liner on the construct conveyor so that at least a portion of the liner extends over at least a portion of the construct and moving the liner in the machine direction on a secondary lug belt of the construct conveyor. The secondary lug belt can comprise a secondary lug and the moving the liner can comprise moving the secondary lug belt in the machine direction so that the secondary lug pushes the liner in the machine direction.

In another aspect, the disclosure is generally directed to a system for at least partially forming reinforced packages. The system can comprise a construct conveyor comprising a primary lug belt with a primary lug and a secondary lug belt with a secondary lug. The construct conveyor can move the primary lug belt and the secondary lug belt in a machine direction. A construct can be positioned on the construct conveyor, and the primary lug can push the construct in the machine direction. A liner can be positioned on the construct conveyor and can at least partially overlap the construct. The secondary lug can push the liner in the machine direction.

In another aspect, the disclosure is generally directed to a method of at least partially forming reinforced packages. The method comprises moving a web of material in a first machine direction through a liner forming section, forming at least a liner portion in the web of material during the moving the web of material through the liner forming section, forming a liner by separating the liner portion from the web of material, moving a construct in a second machine direction on a construct conveyor, transferring the liner to the construct conveyor while moving the liner in the second machine direction, and attaching the liner to the construct while moving the liner and the construct in the second machine direction.

In another aspect, the disclosure is generally directed to a system for at least partially forming reinforced packages. The system can comprise a liner forming section receiving a web of material and at least partially forming at least a liner from the web of material. The liner forming portion can have a first machine direction. A construct conveyor moving a construct in a second machine direction. A transfer station can move the liner formed from the liner forming portion to the construct conveyor. The construct conveyor can move the construct and the liner in a second machine direction. The construct conveyor can comprises attachment features that at least partially attach the liner to the construct.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of forming reinforced packages for holding products such as food products or other articles. Packages according to the present disclosure can accommodate articles of any shape. The packages can comprise a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the liners, in some embodiments enclosing such closed ends, and will provide support for the liners upon loading with a product or article or series of articles therein. In some embodiments, the reinforcing construct can be folded with their liners into a configuration supporting the liners in a freestanding, upright and opened condition for ease of loading and ease of use.

Figure 1:
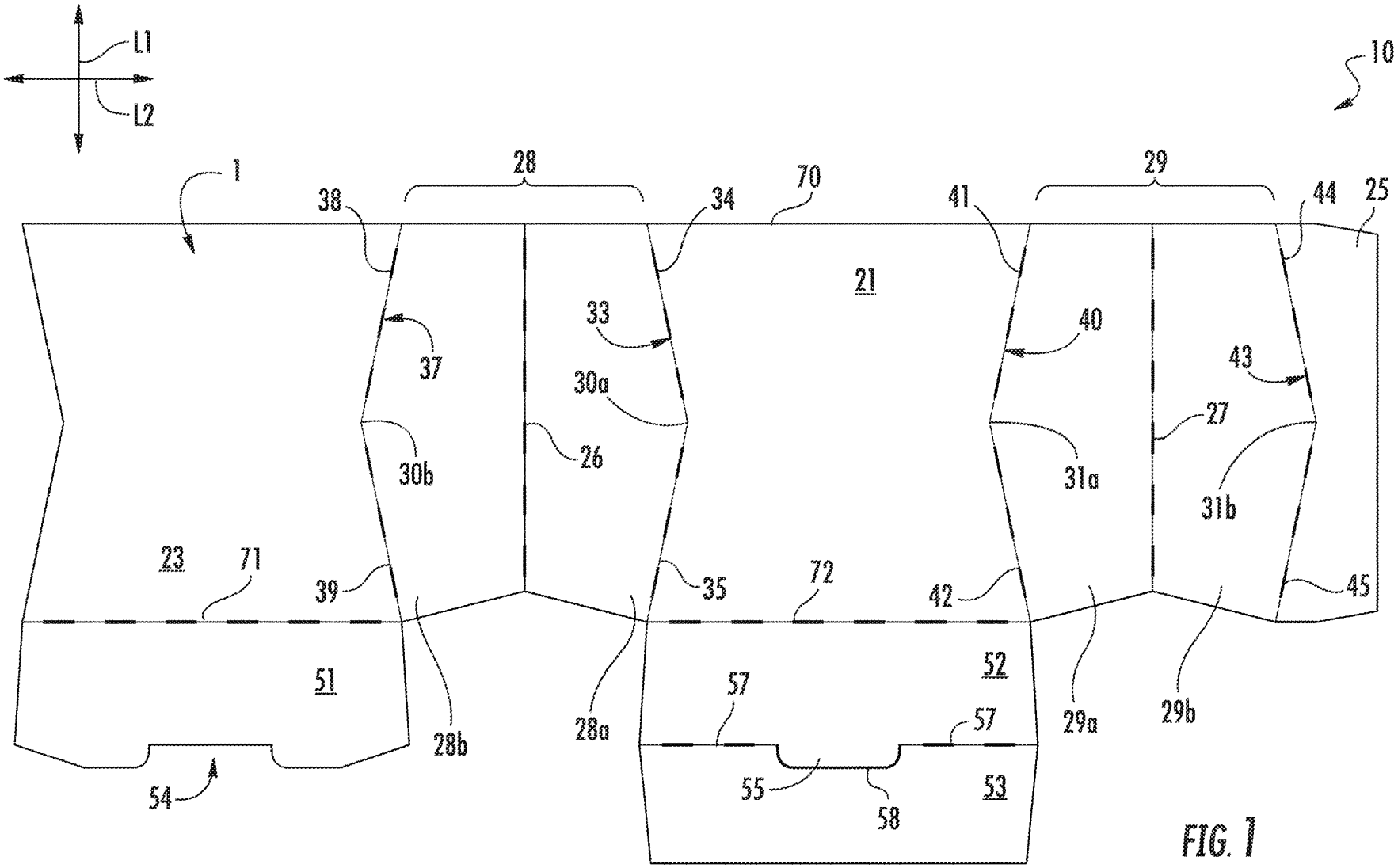
FIG. 1 is an exterior plan view of a blank used to form a carton of a package according to an exemplary embodiment of the disclosure.
Figure 4:
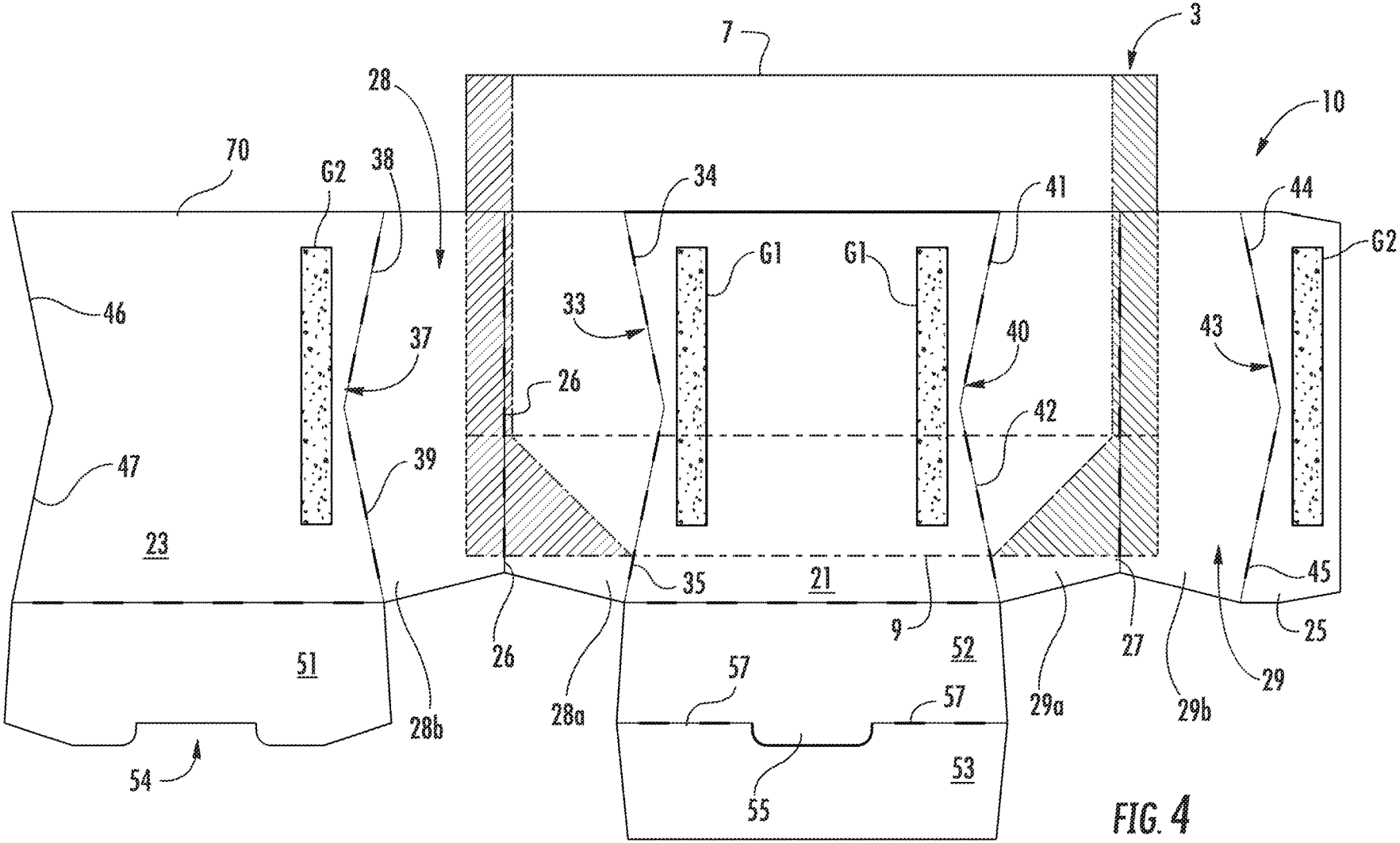
FIG. 4 is an exterior plan view showing the bag formed from a bag portion of FIG. 3 attached to the blank of FIG. 1 according to the exemplary embodiment of the disclosure.
Figure 5:
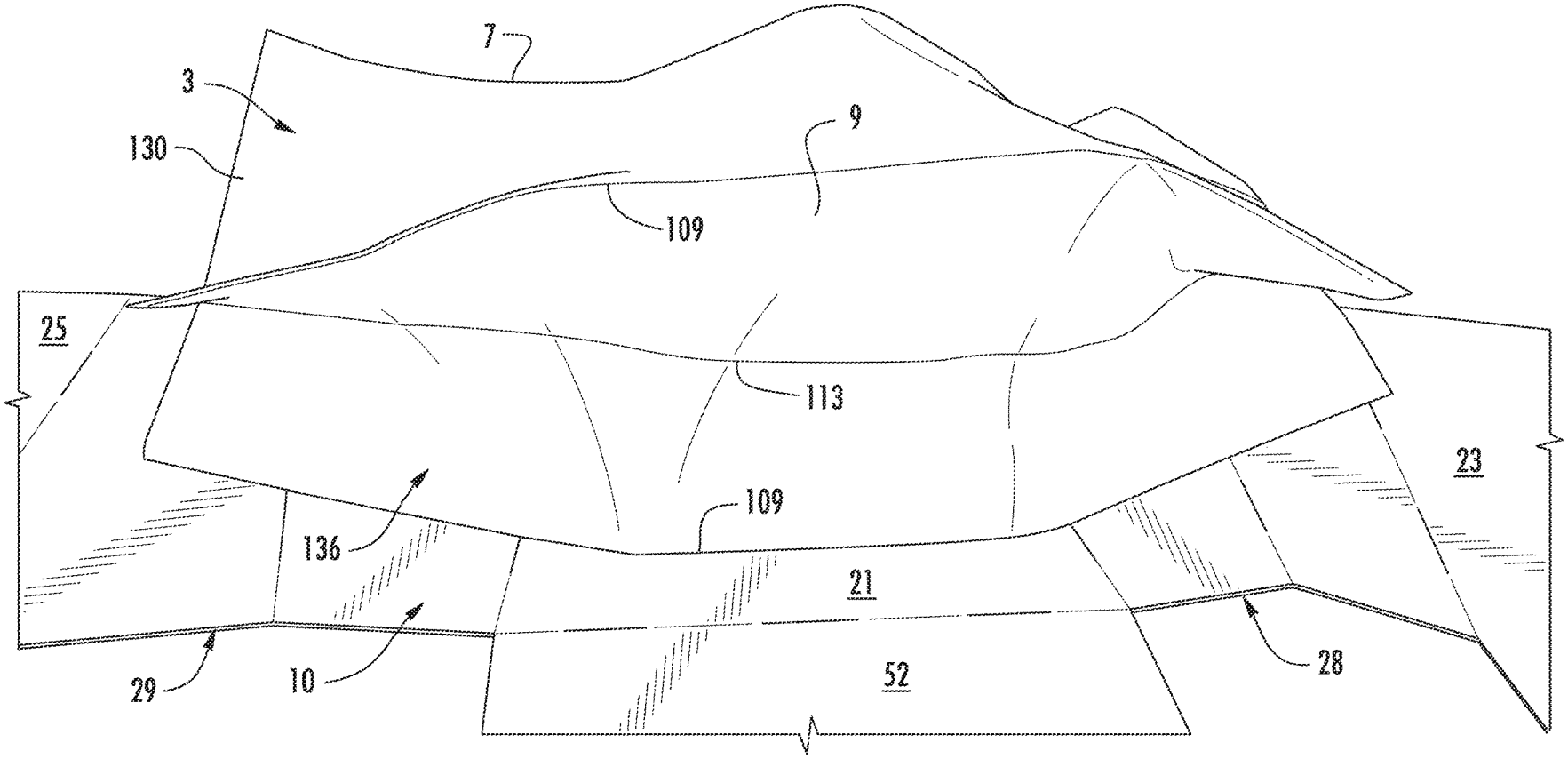
FIG. 5 is a bottom view of the bag on the blank of FIG. 4.

FIG. 1 is a plan view of an interior surface 1 of a carton blank 10 for forming a reinforcing carton 5 (FIGS. 6-9) for holding a liner 3 (e.g., in the form of a bag 3) in a reinforced package 152 (FIGS. 6-9) according to an embodiment of the disclosure. In one embodiment, the reinforced package is similar or identical to the reinforced package of U.S. patent application Ser. No. 14/496,252, filed Sep. 25, 2014, the entire disclosure of which is incorporated by reference herein for all purposes. One embodiment of the system and method of the present disclosure can form a series of attached liner portions 2 (e.g., in the form of attached bag portions 2) (FIG. 3) from a web 101 (FIGS. 2 and 11), separate the attached bag portions 2 from the web to form the separate bags 3, and attach the bags 3 to respective blanks 10 (FIGS. 4 and 5). Alternatively, the bags 3 could be formed separately. The bag 3 has an open top end 7, a closed or sealed bottom end 9, and an interior space 150 for holding a product. In one embodiment, the bag 3 has sealed sides 130 extending the length of the bag. The reinforcing carton 5 has a bottom 20 (FIG. 9) that supports the sealed bottom 9 of the bag 3. Alternatively, the carton 5 could have an open bottom and/or could be positioned to extend around a middle portion or top portion of the bag 3 without departing from the disclosure.

As shown in FIG. 1, the carton blank 10 has a lateral axis L1 and a longitudinal axis L2. In the illustrated embodiment, the carton blank 10 has a front panel 21 foldably connected to a first side panel 28 at a first fold line 33, a back panel 23 foldably connected to the first side panel 28 at a second fold line 37, and a second side panel 29 foldably connected to the front panel 21 at a third fold line 40. As shown in FIG. 1, a second back panel or attachment flap 25 is foldably connected to the second side panel 29 at a fourth fold line 43. In the illustrated embodiment, the first side panel 28 includes two individual panel portions 28*a*, 28*b* foldably connected to one another along a lateral fold line 26. Similarly, the second side panel 29 includes two individual panel portions 29*a*, 29*b* foldably connected to one another along a lateral fold line 27.

In the illustrated embodiment, the first fold line 33 is segmented into two oblique fold line segments 34, 35 extending from a vertex 30*a*. The second fold line 37 is segmented into two oblique fold line segments 38, 39 extending from a vertex 30*b*. The third fold line 40 is segmented into two oblique fold line segments 41, 42 extending from a vertex 31*a*. The fourth fold line 43 is segmented into two oblique fold line segments 44, 45 extending from a vertex 31*b*. The fold lines 33, 37 can be spaced apart from lateral fold line 26 so that the vertices 30*a*, 30*b* are spaced apart from the lateral fold line 26 farther than the opposite ends of the oblique fold line segments 34, 35, 38, 39 (e.g., the panel portions 28*a*, 28*b* and the first side panel 28 are widest between or adjacent the vertices 30*a*, 30*b*). Similarly, the fold lines 40, 43 are spaced apart from lateral fold line 27 so that the vertices 31*a*, 31*b* are spaced apart from the lateral fold line 27 farther than the opposite ends of the oblique fold line segments 41, 42, 44, 48 (e.g., the panel portions 29*a*, 29*b* and the first side panel 29 are widest between or adjacent the vertices 31*a*, 31*b*). The fold lines 33, 37, 40, 43 could be omitted or could be otherwise arranged, shaped, positioned, and/or configured without departing from the disclosure. For example, the fold lines could be arcuate fold lines rather than segmented fold lines as shown.

As shown in FIG. 1, the blank 10 further can include a first bottom panel 51 foldably connected to the back panel 23 at longitudinal fold line 71 and a second bottom panel 52 foldably connected to the front panel 21 at longitudinal fold line 72. As illustrated, a bottom end flap 53 is foldably connected to the second bottom panel 52 at fold lines 57. A locking tab 55 extends from the second bottom panel 52 and is separable from the bottom end flap 53 along a cut 58. Furthermore, a complementary locking notch or recess 54 is formed in the first bottom panel 51 and defines an edge of the first bottom panel 51 for engaging the locking tab 55. The locking notch 54 is sized or dimensioned to engage the locking tab 55, which can engage the notch 54 to assist in the locking the first and second bottom end flaps 41, 45 together to form the bottom 20 of the carton 5. Further, as shown in FIGS. 1 and 4, the blank 10 can have a top edge 70 extending generally in the longitudinal direction L2. Any of the bottom panels 51, 52, the bottom end flap 53, the locking features 54, 55, and/or the top edge 70 could be omitted or could be otherwise arranged, shaped, positioned, and/or configured without departing from the disclosure.

In the illustrated embodiment, the carton blank 10 and carton 5 can comprise any material which is relatively rigid such as paperboard, clay-coated paperboard, solid bleached board (SBB) paperboard, solid bleached sulphate (SBS) paperboard, Kraft line paperboard, or any other suitable material without departing from the disclosure. In alternative embodiments, the carton blank 10 could be otherwise shaped and could have alternative panel, flap, fold line, and/or panel portion arrangements.

In alternative embodiments, the blank 10 can have alternative panel, fold line, and/or panel portion arrangements. U.S. patent application Ser. No. 13/826,937, filed Mar. 14, 2013, is incorporated by reference herein for all purposes, and illustrates various reinforced packages including various reinforcing constructs 5, blanks 10, and bags 3 that can be formed from the method and system of the present disclosure. Alternatively, any suitable construct, carton, blank, and/or liner could be formed by the method and system of the present disclosure.

Figure 6:
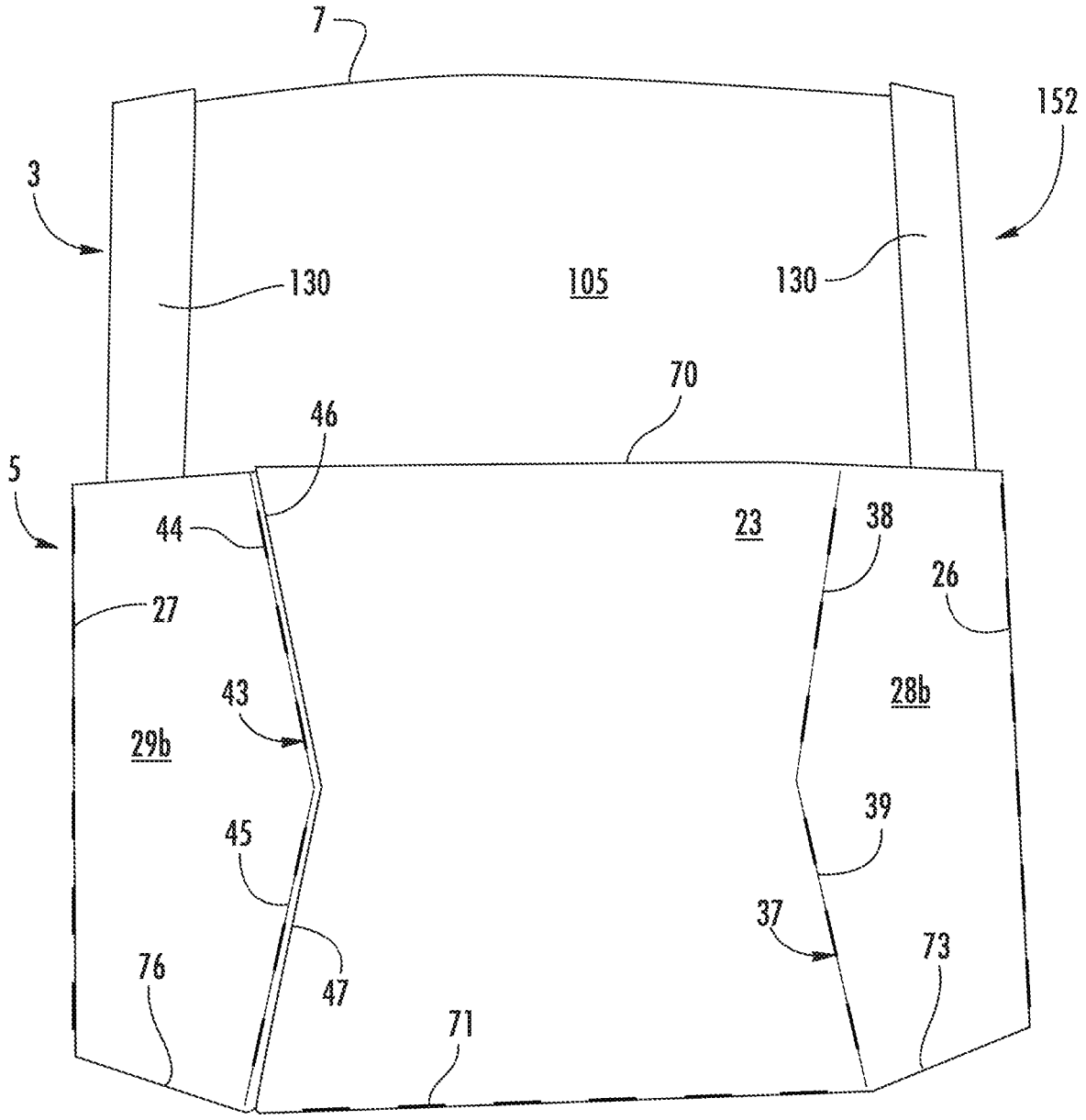
FIGS. 6-10 are various views of the package including the bag of FIG. 4 and the carton formed from the blank of FIG. 4 in a flat configuration and in an erected configuration.

Generally, the back panel 23 and the attachment flap 25 can be overlapped and glued and the blank 10 may be folded about fold lines 26, 27, 33, 37, 40, 43 to position the front panel 21, side panels 28, 29, and overlapped back panel 23 and attachment flap 25 to form the carton 5 (FIG. 6). The bottom panels 51, 52 and the bottom end flap 53 can be overlapped and secured by adhesive and/or by the locking features 54, 55 to from the closed bottom 20 of the carton 5. In the illustrated embodiment, the carton 5 can be positioned in a collapsed configuration (FIG. 6), wherein the front and back panels 21, 23 are brought closer together, folding the side panels 28, 29 along fold lines 26, 27, and an opened configuration wherein the front and back panels 21, 23 are spaced apart and the side panels 28, 29 are folded along the fold lines 33, 37, 40, 43 and pushed inwardly. The bottom 20 can fold inwardly when the carton 5 is in the collapsed configuration in the illustrated embodiment. The reinforced carton 5 may be otherwise shaped, arranged, and configured without departing from the disclosure. For example, the bottom 20 could be configured to fold outwardly when the carton is in the collapsed configuration.

Figure 2:
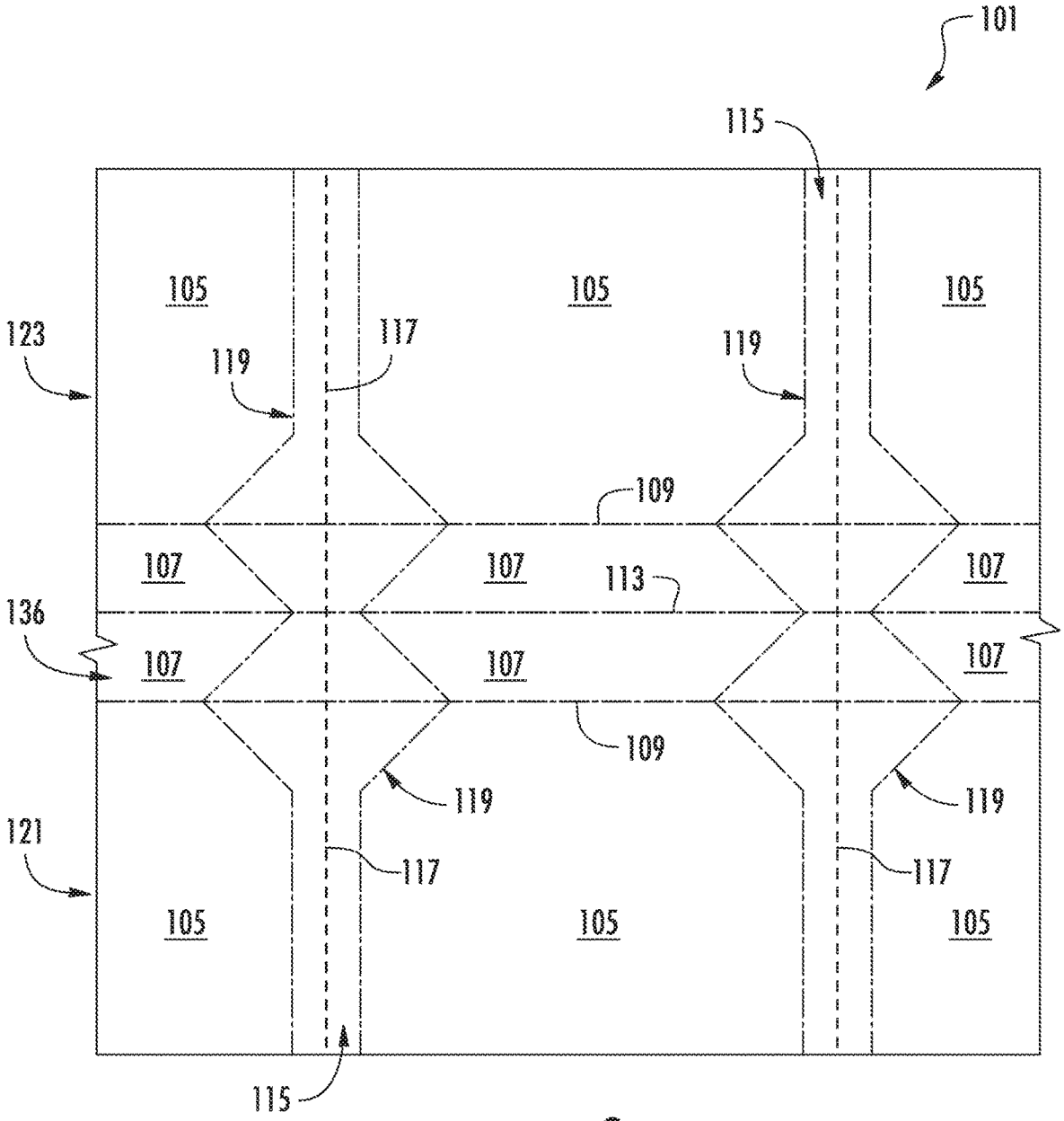
FIG. 2 is a plan view of a portion of a web for forming a bag of the package 152 according to the exemplary embodiment of the disclosure.

FIG. 2 shows a web 101 for forming the bags 3 that are attached to the respective blanks 10. The web 101 in FIG. 2 includes a number of lines schematically showing the relative location of different features formed in the web by the system and method of the present disclosure. These lines may or may not be formed in the web prior to forming the bags (e.g., before the web is folded, heat sealed, and/or cut). For example, the fold lines can be formed as the web is folded, the boarders of the heat sealed areas can be formed by the shape of the heating elements as the web is heat sealed, and/or the perforation lines can be formed by a perforator. Alternatively, some or all of the lines could be printed or otherwise formed in the web prior to forming the bags.

The web 101 may be formed of generally non-permeable material or layers of material, such that a formed bag 3 may hold liquid. The web 101 can comprise any suitable material which is relatively flexible and relatively fluid impervious. The web 101 can comprise paper material laminated with plastics such as polyethylene, polypropylene, polyethylene terephthalate, polystyrene, polyvinyl chloride, or any other suitable material without departing from the disclosure. In one embodiment, the web 101 can include a heat seal layer (e.g., on an interior surface of the web). Alternatively, the web 101 could comprise a fluid pervious material or any other suitable material without departing from the disclosure.

As shown in FIG. 2, the web 101 may include two sidewalls 105 foldably connected to gusset panels 107 at fold lines 109, respectively, for each portion that forms a respective bag 3. The gusset panels 107 may be foldably connected to one another at fold line 113. The web 101 may include seal areas 115 extending along respective marginal areas of each portion that forms a respective bag 3 and at least partially defined between lines 119. Any of the sidewalls 105, the gusset panels 107, and/or the seal areas 115 could be omitted or could be otherwise arranged, shaped, positioned, and/or configured without departing from the disclosure.

Figure 3:
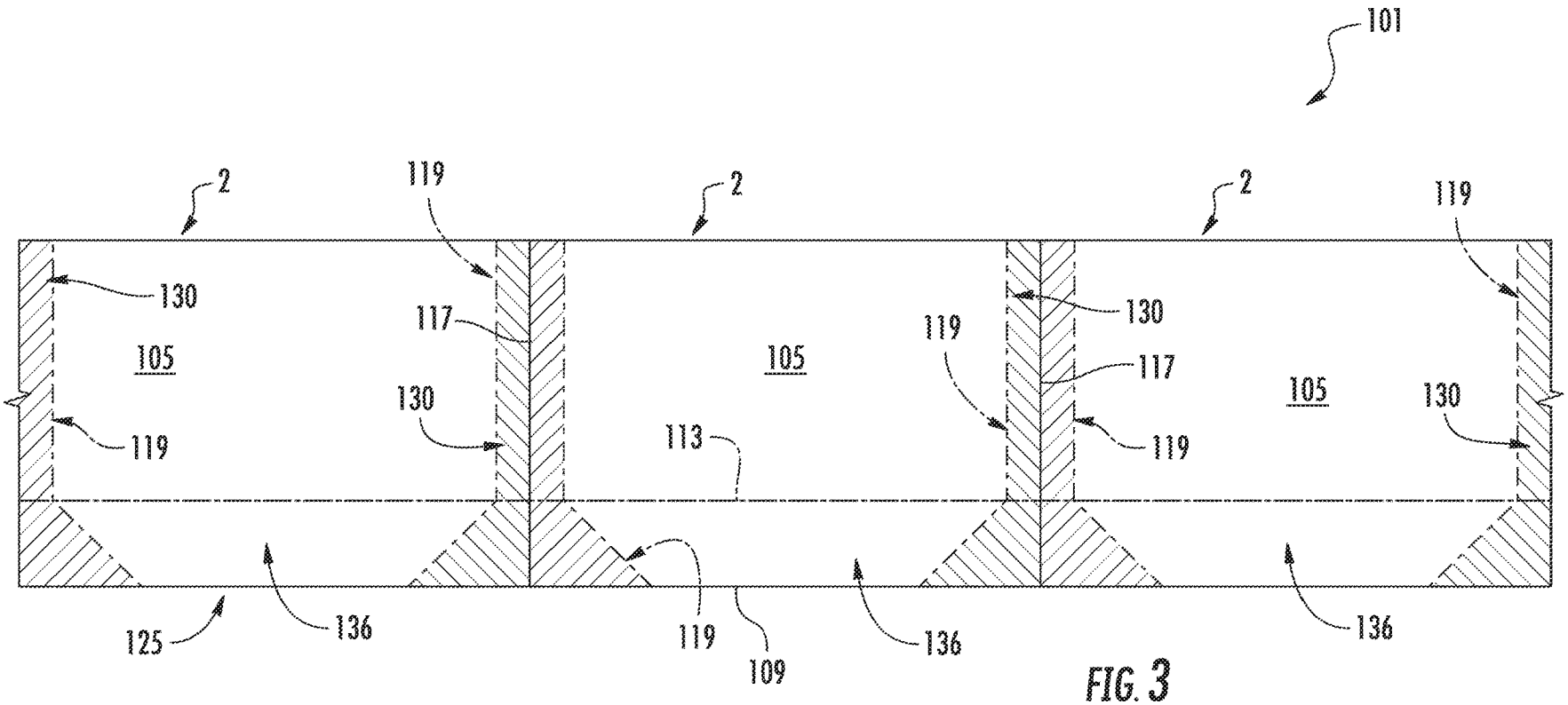
FIG. 3 is an exterior plan view of the web of FIG. 2 after folding the web and forming bag portions according to the exemplary embodiment of the disclosure.

In one embodiment, and as described further below, the system and method of the present disclosure can include a liner forming section that generally can fold the web 101 and form heat sealed areas in the web to form the attached bag portions 2 (FIG. 3). In the illustrated embodiment, the web forming section folds a first portion 121 of the web 101 over a second portion 123 of the web while pushing the gusset panels 107 inwardly to form a gusset 136 (FIGS. 3-5 and 10). The folding of the web 101 can form the fold lines 109, 113 where the web 101 is folded. The web forming section further can form heat sealed areas 130 at the seal areas 115 in the web 101 so that portions of the web 101 are sealed at the bottom by the gusset 136 and at the sides by heat sealed areas 130. As shown in FIG. 3, the heat sealed areas 130 extend along the marginal portions of each bag portion 2 so that the heat sealed areas 130 each extend along the marginal side portions of two adjacent bag portions 2. Accordingly, the web 101 is folded and sealed to form a series 125 of bag portions 2 as shown in FIG. 3.

In the illustrated embodiment, the bag portions 2 can be separated from the series 125 by cutting at locations indicated by lines 117, generally bifurcating the heat sealed areas 130, and can be glued to the front panels 21 of respective blanks 10 along glue strips G1, for example (FIGS. 4 and 5). In one embodiment, additional glue strips G2 subsequently can be applied to the blank 10 for attaching the attachment flap 25 to the back panel 23 and/or for attaching the back panel 23 and/or the attachment flap 25 to the bag. The bag 3 could be formed from the web 101 by alternative steps without departing from the disclosure. For example, the lines 117 could be lines of weakening 117 (e.g., tear lines or perforation lines) in the web 101 so that the sealed portions of the web 101 are separable from one another along the perforation lines 117 in an alternative embodiment.

Figure 7:
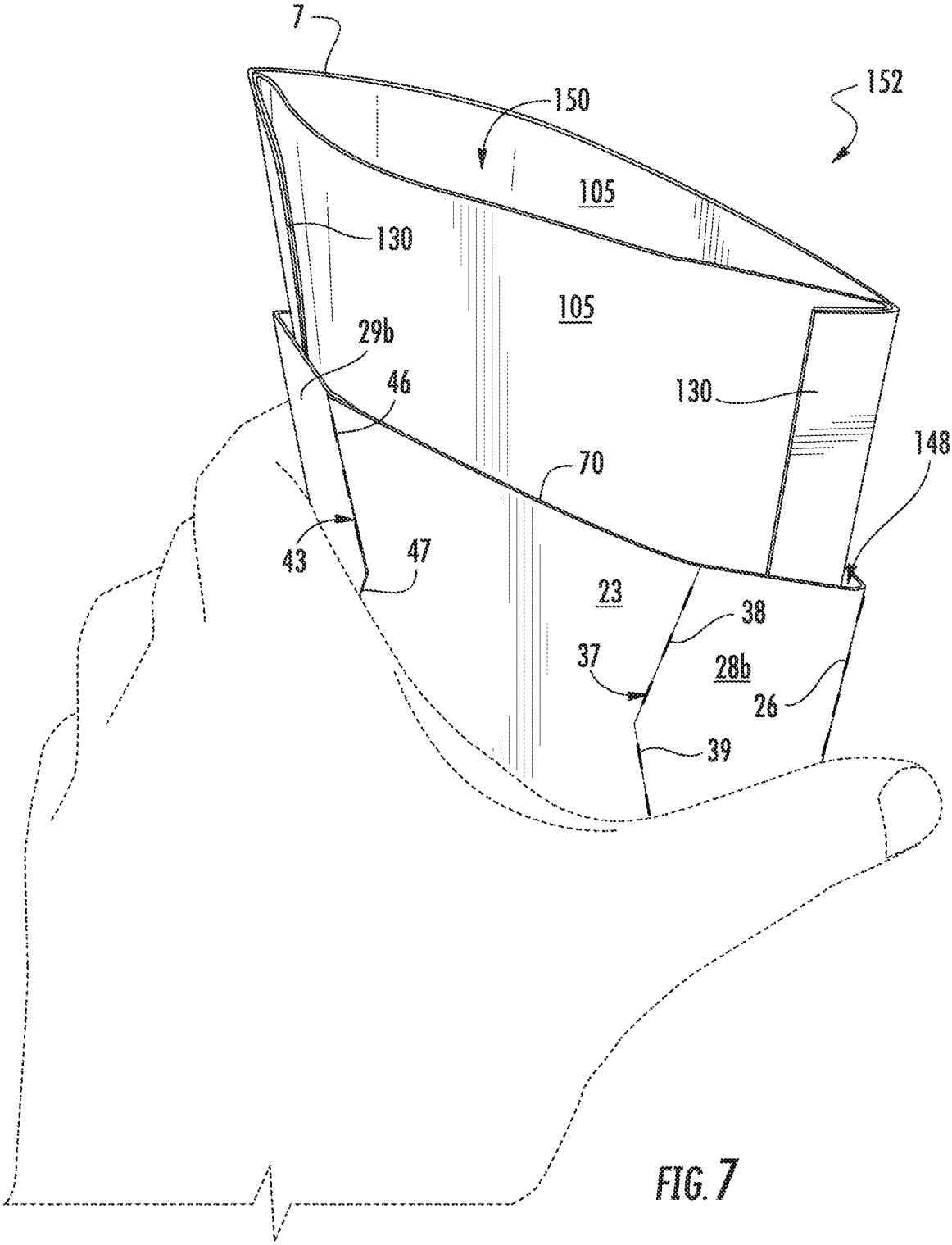
Figure 8:
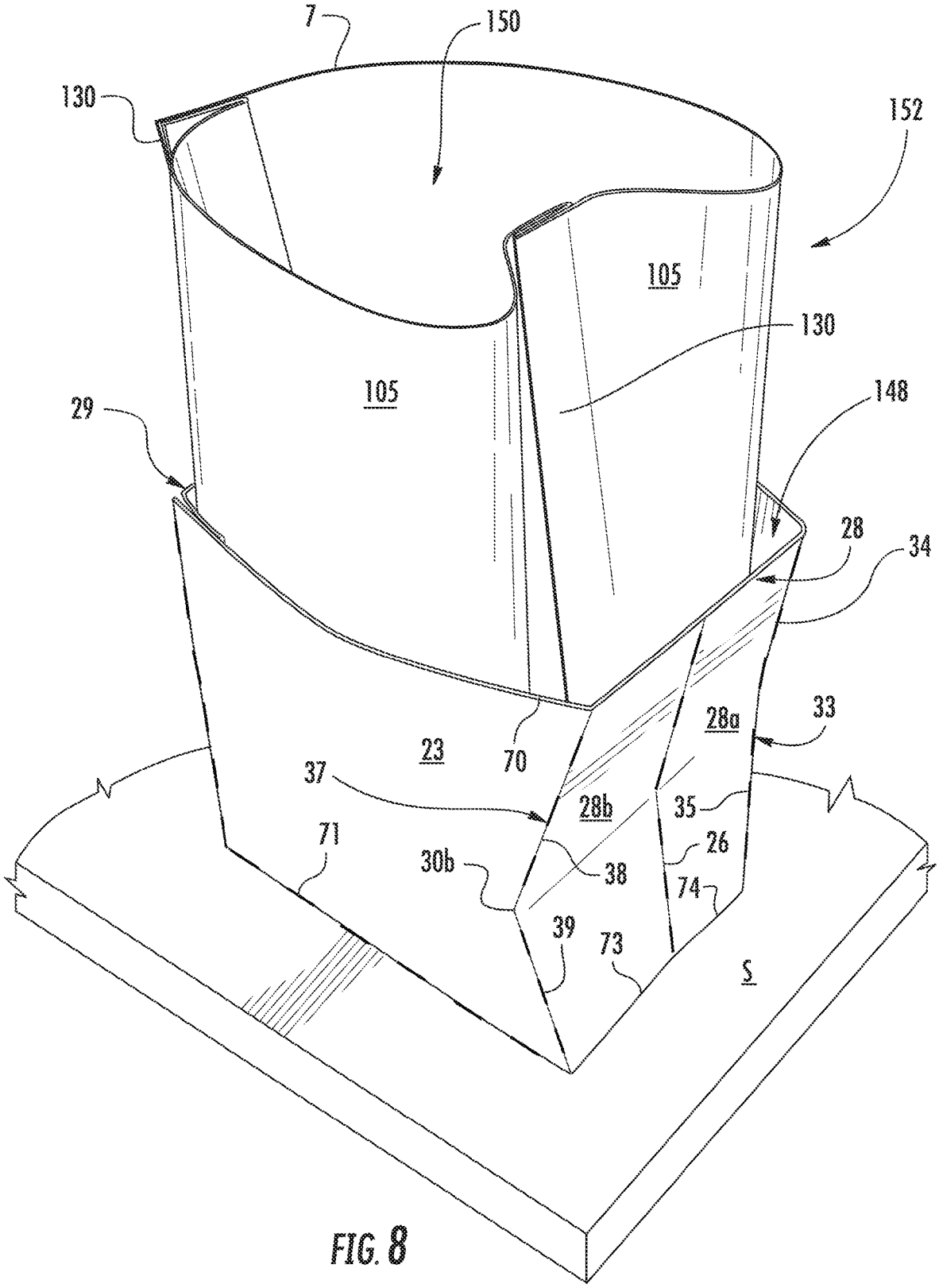
Figure 9:
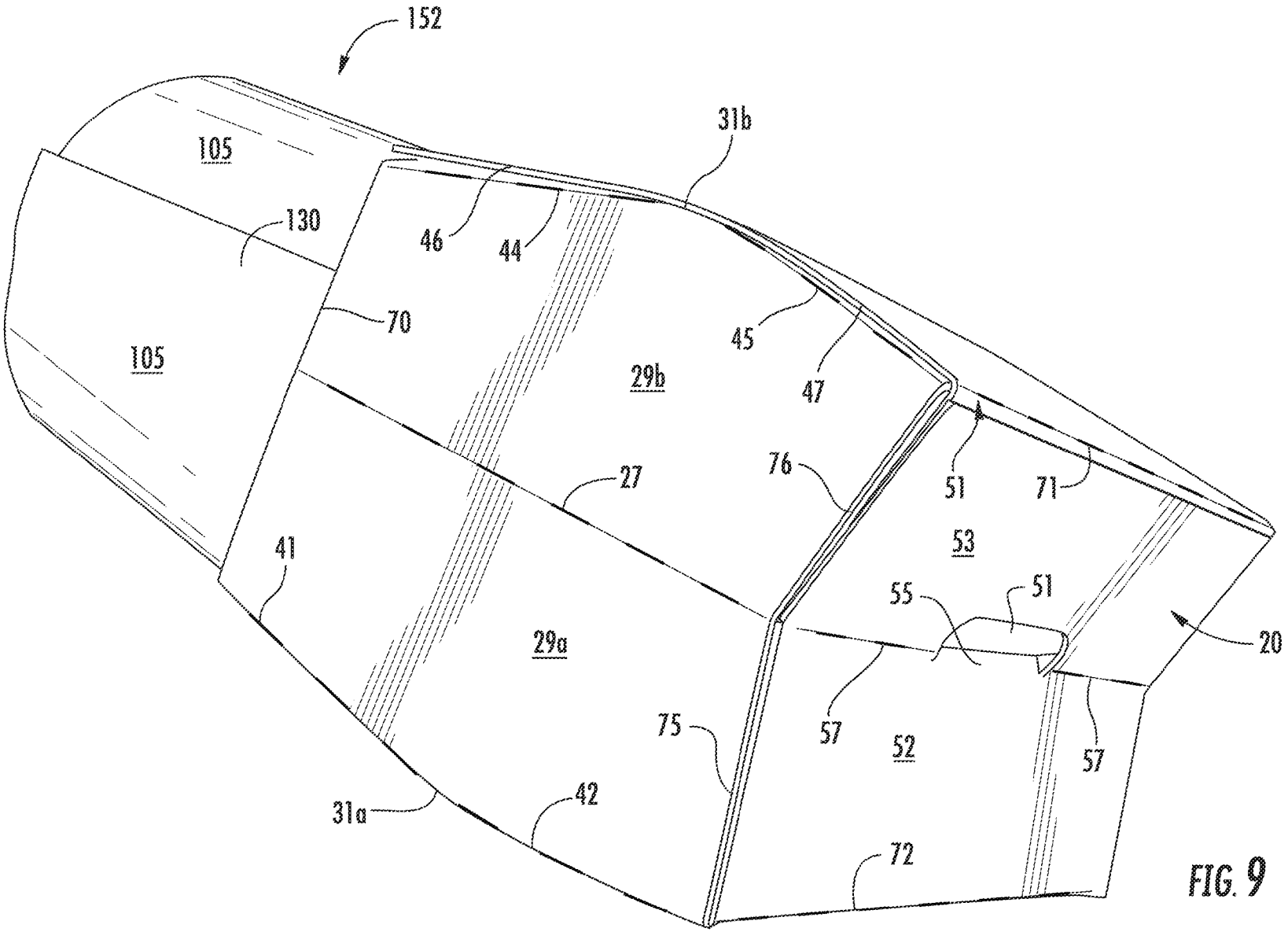
Figure 10:
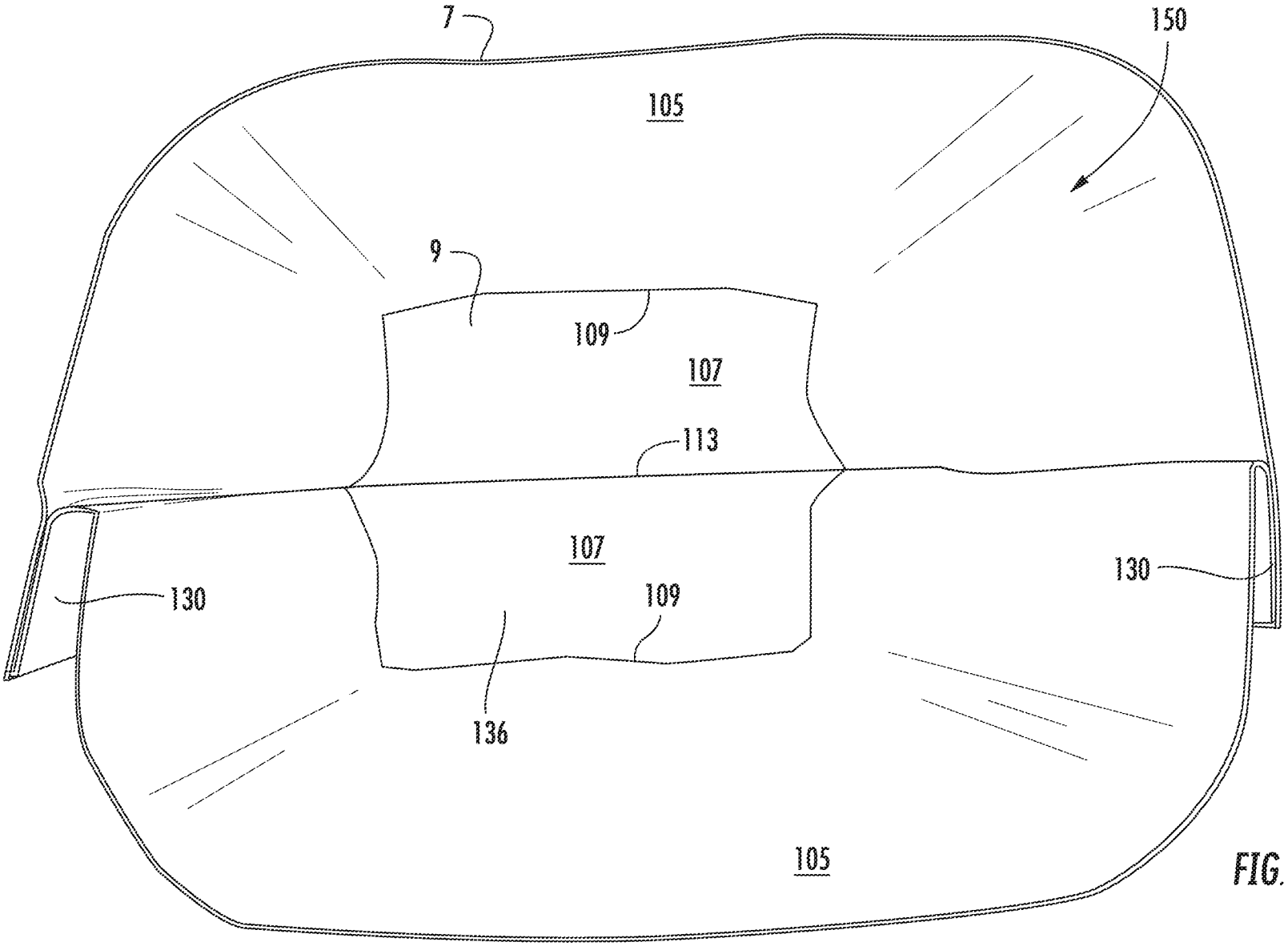

The package 152 can be formed by forming the carton 5 around the bag 3 from the combination of the bag 3 and the blank 10 shown in FIGS. 4 and 5 such as by a folder/gluer system (not shown). The package 152 can be in the collapsed configuration (FIG. 6) and the side panels 28, 29 can be squeezed inwardly (FIG. 7) to erect the package 152 into the opened configuration (FIGS. 8-10). The first, non-erect position illustrated reduces and/or minimizes (e.g., collapses) a volume of an interior space 150 of the bag 3 such that the reinforced package is in a non-erect or semi-flattened state. The non-erect state may facilitate easy stacking of a plurality of packages into, for example, a shipment container and subsequent organization at a destination facility. When the package 152 is moved to the erected or opened configuration, the side panels 28, 29 are pushed inwardly at the respective fold lines 26, 33, 37 and 27, 40, 43 (FIGS. 7 and 8). Accordingly, the front panel 21 and the back panel 23 move away from one another and the bottom panels 51, 52 can fold along fold lines 57, 71, 72 to be generally coplanar, extending between the front panel and the back panel (FIG. 9). Further, the sidewalls 105 of the bag 3 are glued to the respective front panel 21 and back panel 23 of the carton 5, and the bag can be positioned in the open position by the front and back panels as the side panels 28, 29 are moved inwardly (FIGS. 8-10). In one embodiment, as the panels 105 of the bag 3 move away from one another, the gusset panels 107 can fold along fold lines 109, 113 to extend across the bottom 9 of the opened bag 3 (e.g., as shown in FIGS. 5 and 10). In the illustrated embodiment, the bag 3 is sealed at its sides by the heat sealed areas 130 and at its bottom by the gusset panels 107 when the package 152 is in the collapsed configuration and in the opened configuration. In the illustrated embodiment, the carton 5 can help retain the bag 3 in the open configuration and can help support the bag 3 when held by a user and/or when resting on a surface S (e.g., FIG. 8). The package could be otherwise shaped, arranged, and/or configured without departing from the disclosure.

Figure 11:
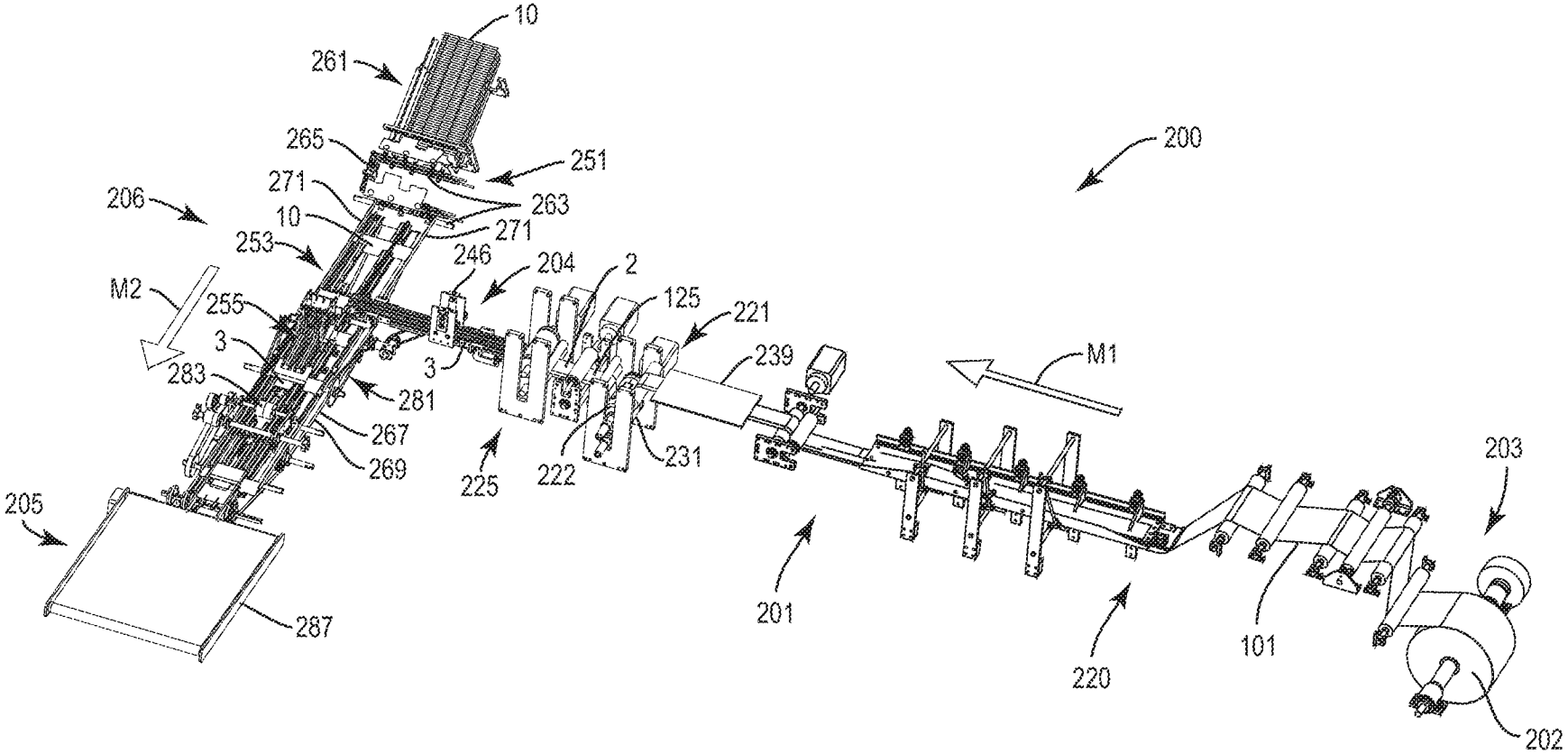
FIGS. 11 and 12 are schematic perspective views of a system and method for forming the bag portions of FIG. 3 in the web of FIG. 2, separating the bag portions into the bags of FIG. 4, and attaching the bags to the blanks of FIG. 1 to form the combination of the bag and the blank of FIG. 4 according to a first embodiment of the disclosure.

FIG. 11 illustrates an exemplary embodiment of a system 200 and method for forming combinations of a construct attached to a liner (e.g., the bag 3 attached to the blank 10 as shown in FIGS. 4 and 5), which combinations can be formed into reinforced packages (e.g., reinforced packages 152) in accordance with the disclosure. In the illustrated embodiment, a bag forming section 201 (broadly: "liner forming section") of the packaging system 200 forms the web 101 into the series 125 of bag portions 2 (broadly: "liner portions") at an upstream end 203 of the system 200 and the web 101 can move in a first machine direction M1 through the bag forming section 201 to a transfer station 204 where the bags 3 (broadly: "liners") can be separated from the series 125 of bag portions 2 and transferred to a construct attachment system 206. The bags 3 can be attached to respective constructs 10 (e.g., the blank 10 shown in FIG. 1) by the construct attachment system 206 and moved to a downstream end 205 generally in a machine direction M2 that is nonparallel (e.g., transverse) to the first machine direction M1. The combinations of the constructs 10 with the attached bags 3 can be output from the system 200 directly to a folder/gluer system (not shown), could be transported to a separate folder/gluer system, and/or could be manually glued and folded to form the packages 152. The system and method 200 of the present disclosure can include similar or identical features, methods, processes, and/or components as the system and methods disclosed in incorporated-by-reference U.S. patent application Ser. No. 15/209,013, filed Jul. 13, 2016 (the '013 Application), U.S. patent application Ser. No. 15/142,103, filed Apr. 29, 2016 (the '103 Application), and U.S. patent application Ser. No. 15/142,435, filed Apr. 29, 2016 (the '435 Application). While the system 200 is shown and described in connection with the bags 3 and the constructs 10 of FIGS. 1-10, any suitable construct or liner could be used with the system 200 without departing from the disclosure.

Figure 14:
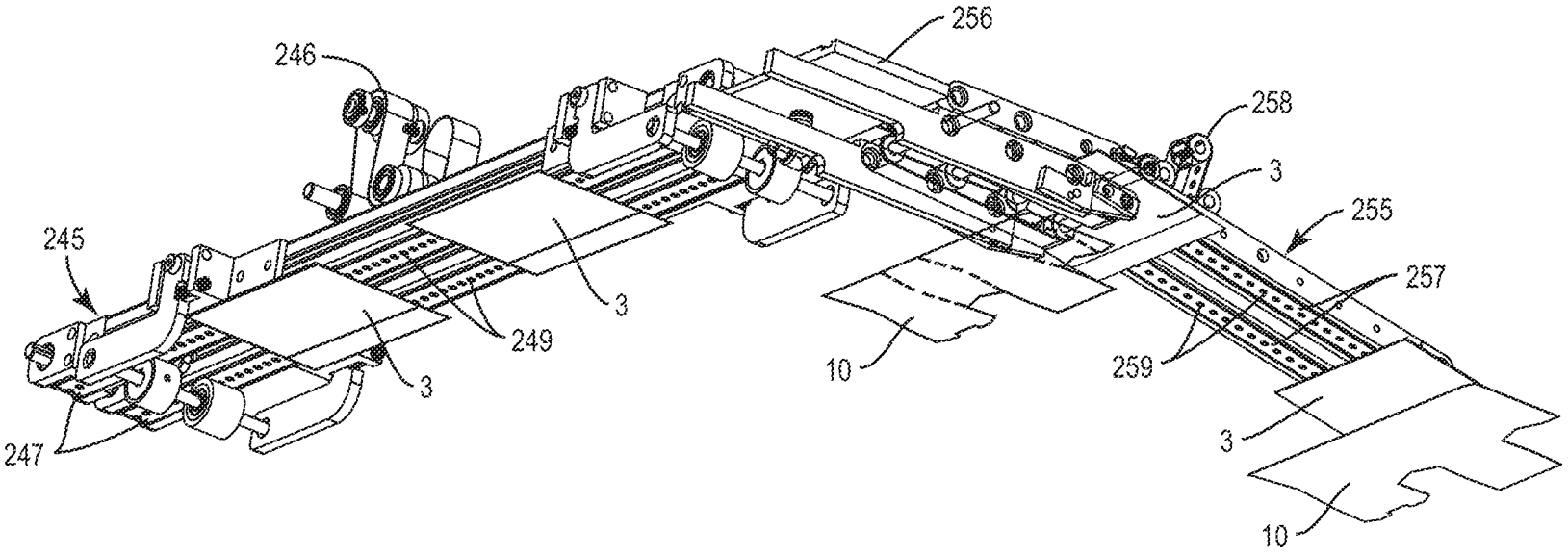
FIG. 14 is a schematic perspective view of two bag conveyors of the transfer station of the system of FIG. 13.
Figure 15:
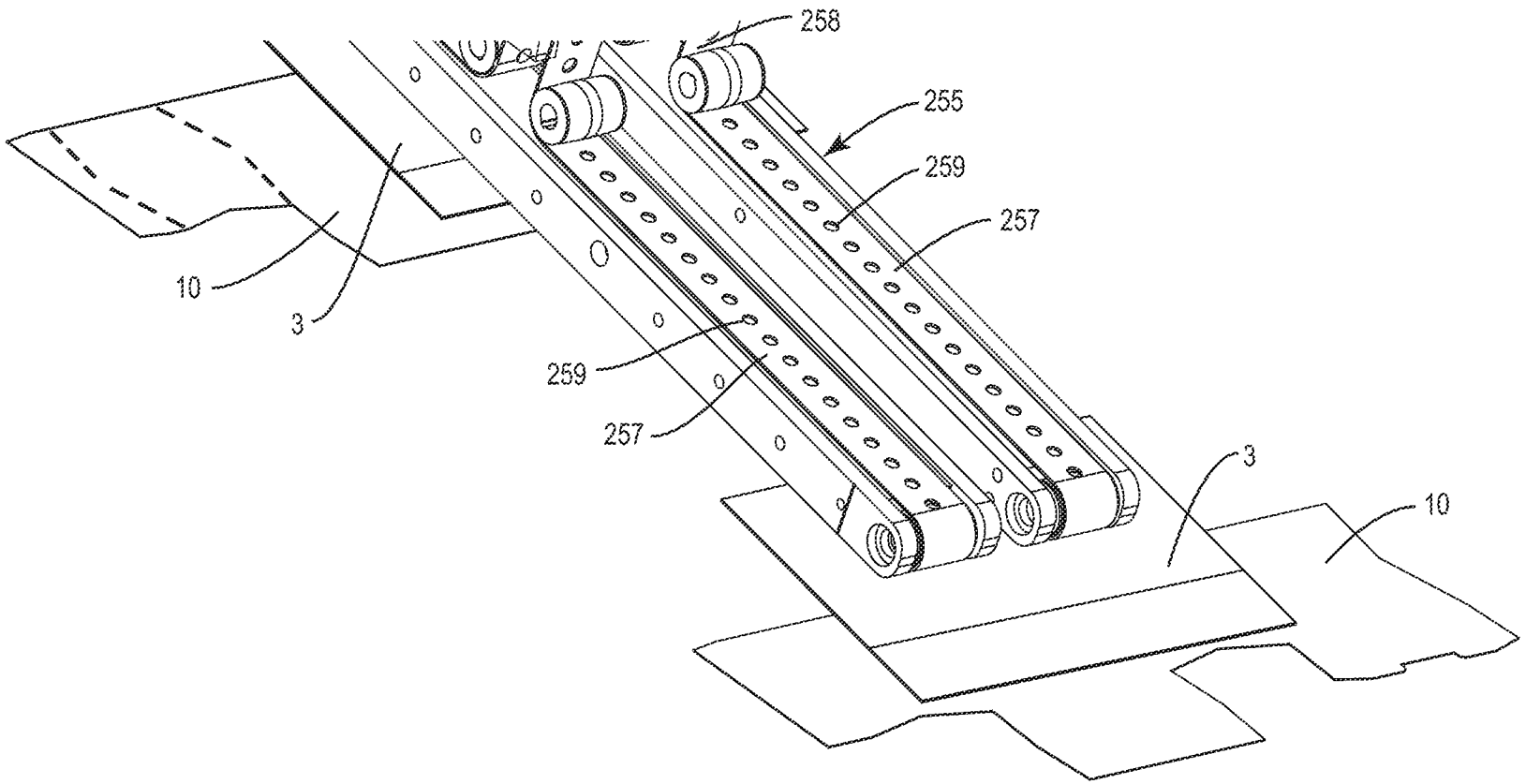
FIG. 15 is a schematic perspective view showing the overlaying of a bag on a construct by the bag conveyor of FIG. 14 according to the first embodiment of the disclosure.
Figure 16:
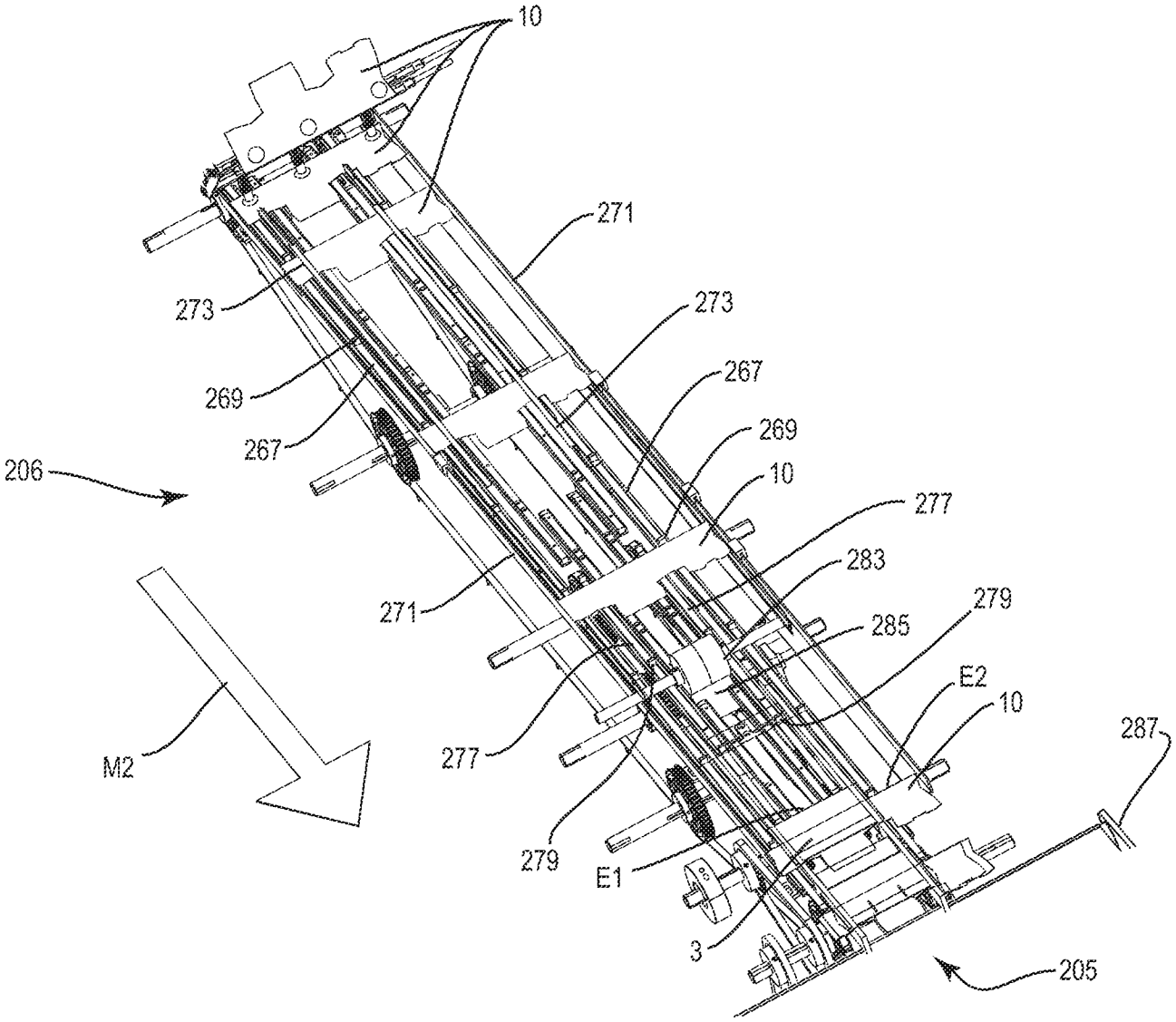
FIG. 16 is a schematic perspective view of a construct conveyor of the system of FIGS. 11 and 12 according to the first embodiment of the disclosure.

As shown in FIG. 11, in one embodiment of the system and method 200 for manufacturing the combinations of the bags 3 attached to the respective blanks 10 for forming reinforced packages 152, the web of bag material 101 can include preprinted paper, polyethylene or other suitable material including flexible and heat-sealable materials (e.g., the bag 3 can have a heat sealable coating on an interior surface). The bag material 101 can be pre-printed with various designs, lettering, labels or other graphics. Alternatively, the web 101 could be free from printed material and/or labels. In one alternative embodiment, the web 101 can be perforated, printed roll stock that can include patterned adhesive that is positioned to facilitate forming the web 101 into the bags 3. In the bag forming portion 201 of the system 200, the web of material 101 is fed from a roll or supply 202 to a folding station 220 in the first machine direction M1, and the web 101 of material passes through the folding station 220 where the web 101 is folded (e.g., in a direction that is transverse to the machine direction M1) while the bottom 9 of the bags 3 are formed to include a bottom gusset 136 having folds 109, 113 (e.g., FIGS. 3, 5, and 10). The gusset 136 and the folded web can be formed by folding a first portion 121 of the web 101 over a second portion 123 (e.g., FIG. 2) while pushing the gusset panels 107 inwardly (e.g., with a horizontal guide plate). The folding of the web 101 and the formation of the gusset 136 can be similar to the formation of the pouch 48 and the gusset 52 as shown in FIGS. 14-16 of the incorporated-by-reference '435 Application. The folded web 101 and the gusset 136 could be otherwise formed without departing from the disclosure.

Figure 12:
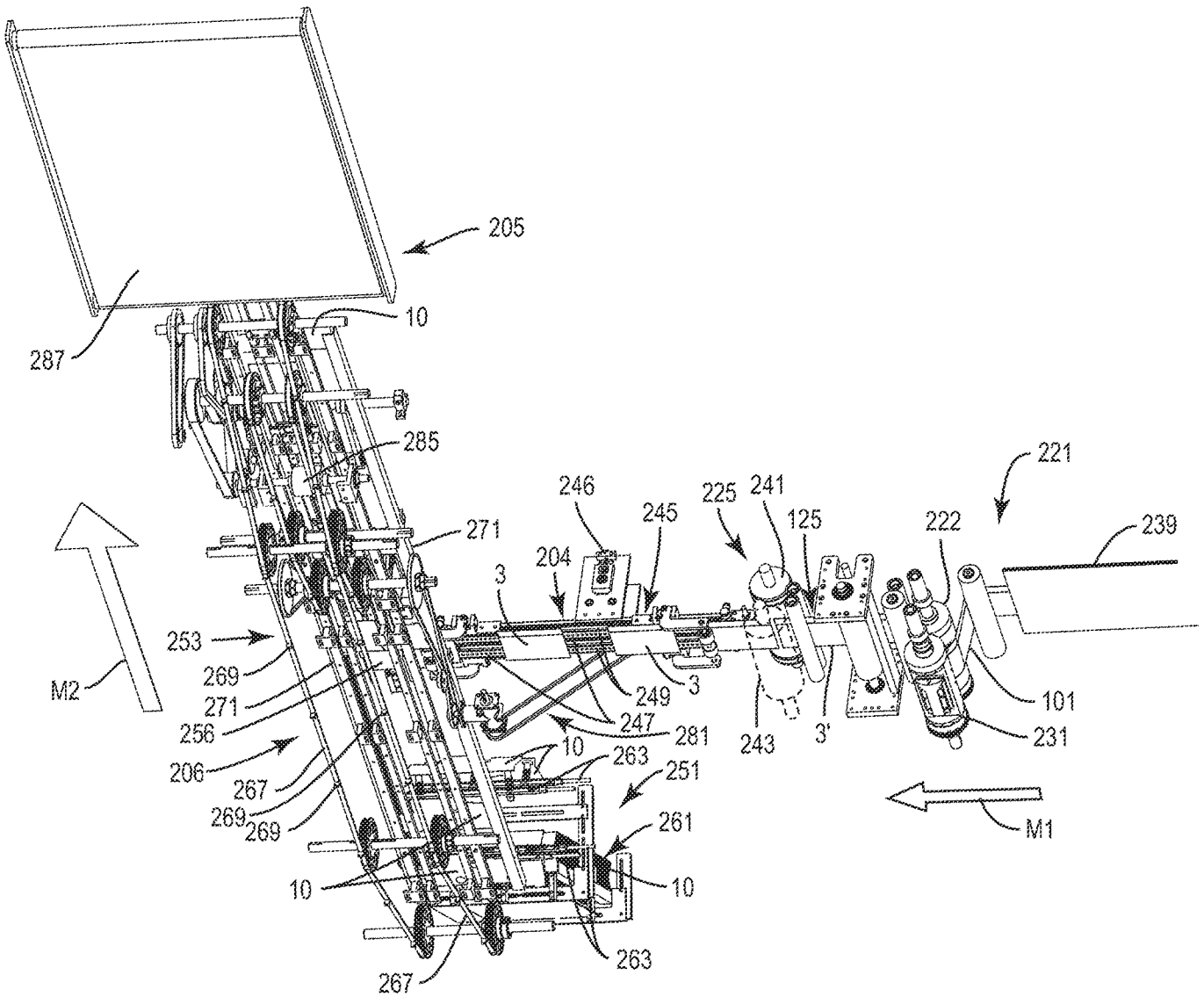

The web 101 moves through a heat sealer assembly 221 (FIGS. 11 and 12) that is downstream from the folding station 220. The heat seal assembly 221 forms the heat sealed side portions 130 of each bag formed in the web 101. The heat sealer assembly 221 bonds overlapped portions of the web of material 101 to from the sealed side portions 130 of the bag 3 such as by pressing the seal areas 115 (FIG. 2) between heated elements. The heat sealer assembly 221 can be a rotary heat sealer assembly that is similar or identical to the rotary heat sealer assembly of the incorporated-by-reference '013 Application. As shown in FIGS. 11 and 12, the heat sealer assembly 221 can include a heat seal roller 222 with circumferentially spaced heating elements (not shown), which can be configured to engage the heat seal areas 115 of the web 101 as the web moves through the heat sealer assembly 221. In one embodiment, the heating elements can protrude from the surface of the heat seal roller 222 and/or the heat seal roller 222 could be cut away adjacent the heating elements. A roller 231 can be disposed opposite to the heat seal roller 222 so that the web 101 passes between the heat seal roller 222 and the roller 231 and the heating elements press the heat seal areas 115 against the roller 231 as the web 101 passes therebetween. In the illustrated embodiment, the roller 231 can include heating elements 232 that correspond to and cooperate with the heating elements (not shown) in the roller 222. Alternatively, the heating elements 232 could be omitted from the roller 231 without departing from the disclosure.

In one embodiment, the heating elements are heated so that the combination of pressure between the heating element and the roller 231 and the heat of the heating element on the web of material 101 can cause the layers of the folded web 101 to seal together (e.g., by at least partially softening and/or melting the heat seal layers on the inner surfaces of the four plies of material at the sides of the gusset 136 and of the two plies of material at the sides of the bag portion above the gusset so that the contacting heat seal layers at least partially fuse together). In one embodiment, the face (FIG. 12) of each heating element can be shaped to correspond to the shape of the heat sealed area 130 (FIGS. 3 and 4). The spacing of the heating elements and the rotation of the heat seal roller 222 can be configured so that the heat sealed areas 130 are formed in the web 101 in intervals corresponding to the length of the bag portions 2 (e.g., so that the heat seal areas extend along the marginal side portions of the bag portions). The heat sealer assembly 221 could include any suitable number of heating elements, and one or both of the rollers 222, 231 could be replaced by any other suitable surface for forming the seal areas without departing from the disclosure.

As shown in FIGS. 11 and 12, the heat seal roller 222 can be positioned below the plane of the web 101 moving into and out of the heat sealer assembly 221 so that the web 101 extends over a guide roller and downwardly along the surface of the heat seal roller on the upstream side of the roller. The web 101 then extends around the bottom of the heat seal roller 222 and up the downstream side of the roller over another guide roller. Accordingly, the portions of the web 101 that are sealed to form the heat sealed areas 130 are in contact with the respective heating elements for a longer time than when the web 101 moves straight through the assembly. Stated another way, moving the heat seal roller downwardly and including guide rollers can increase the dwell time that the heat sealed areas 130 are in contact with the heating elements, which can help improve heat sealing of the web. Similarly, moving the heat seal roller 222 above the plane of the web 101 can increase dwell time. In one embodiment, displacing the heat seal roller 222 with respect to the plane of the web 101 can also add a slight curl bias to the bags 3. For example, displacing the heat seal roller 222 downwardly as shown in FIGS. 11 and 12 can result in the face of the bag 3 that is facing up in the figures to be slightly shorter than the opposing face so that the bags have a slight upward curl bias. Such a bias can help prevent wrinkling of the bags 3 during folding and/or gluing of the package 152 when the downward faces of the bags 3 are initially attached to the respective blanks 10. As the web 101 moves along the heat seal roller 222, the unsealed areas of the bag portions 2 outside the heat sealed areas 130 can engage the outer surface of the heat seal roller 222, which can be cooler that the heating elements 233 that engage the heat sealed areas 130.

In one embodiment, a preheater 239 can generally warm the web 101 prior to moving the web through the heat sealer assembly 221 to help reduce the amount of dwell time needed for forming the heat sealed areas 130. The heat sealer assembly 221, including any or all of the heat seal roller 222, the roller 231, the heating elements, the guide rollers, and the preheater 239, could be omitted or could be otherwise arranged, shaped, positioned, and/or configured without departing from the disclosure. For example, the heat sealer assembly could be similar to the rotary bag sealer assembly disclosed in the incorporated-by-reference '103 Application and/or incorporated-by-reference the '435 Application.

As shown in FIGS. 11 and 12, the heat-sealed web 101 passes from the heat sealer assembly 221 through a bag separating station 225 (broadly: a liner separating station 255) that can separate the individual bags 3 from the series 125 of bag portions 2 in the web 101. In the illustrated embodiment, the bag separating station 225 can include two opposed rollers 241, 243 between which the web 101 passes as it moves in the downstream direction M1. In one embodiment, one or both of the rollers 241, 243 could include one or more cutting tools (not shown) configured to cut the web 101 along the heat sealed areas 130 to separate the bags 3 from the web 101. In FIG. 12, the roller 243 is shown in phantom so that a gap is visible between a bag 3 and the web 101 after the bag 3 has been separated. The bag separating station 225 could be omitted or could be otherwise arranged, shaped, positioned, and/or configured without departing from the disclosure. For example, the web 101 can be perforated (e.g., by passing through a perforating station, not shown, or prior to being supplied to the system 200), and the rollers 241, 243 can rotate at a faster rate than the speed of the web 101 through the remainder of the system (e.g., the heat sealer assembly 221) so that the bags 3 are accelerated with respect to the remainder of the web 101. Accordingly, the bags 3 are torn from the remainder of the web 101 along the perforations (e.g., as indicated by lines 117 shown in FIGS. 2 and 3). In one example, the bag separating station 225 can be similar or identical to the separating station of the incorporated-by-reference '013 Application.

Figure 13:
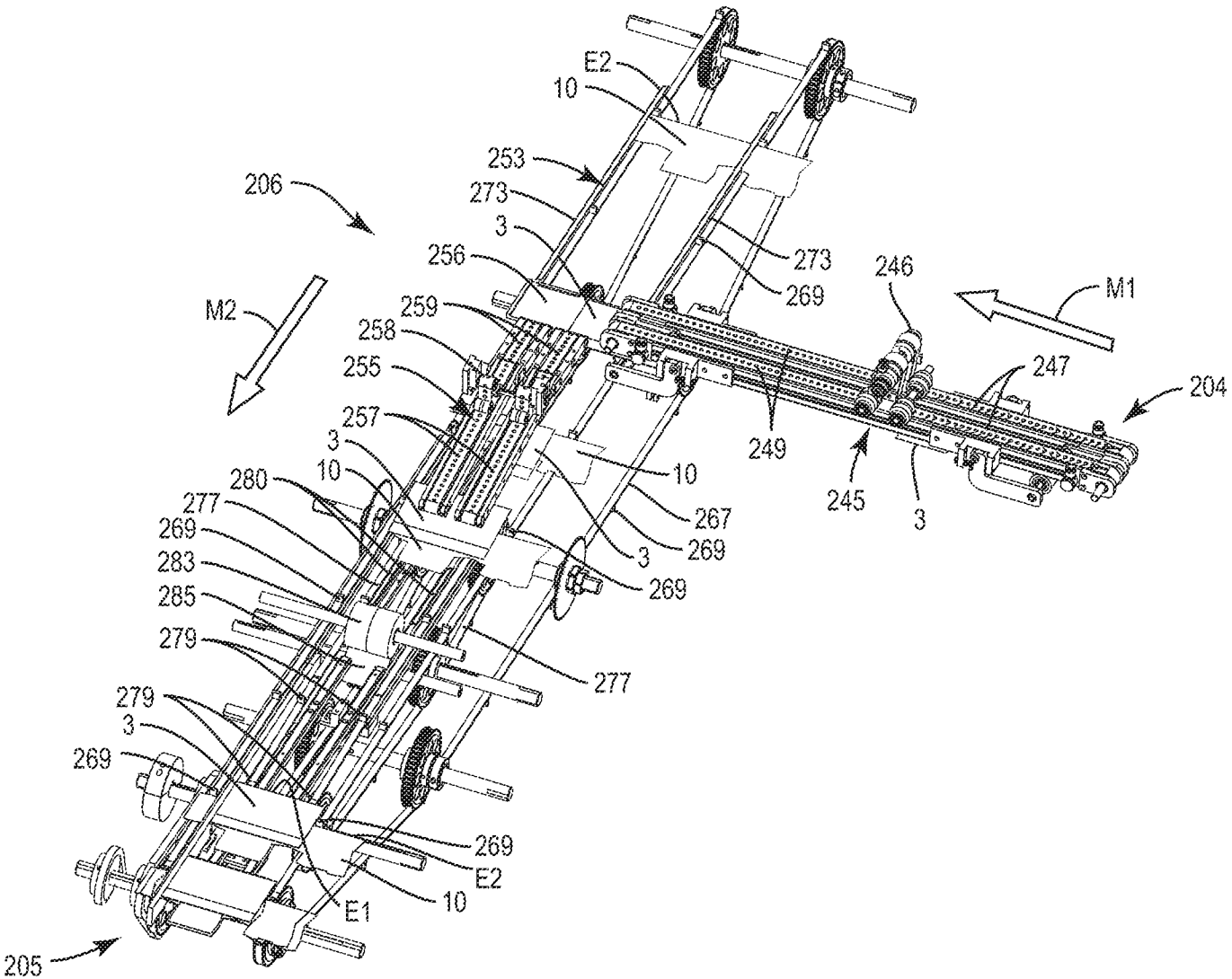
FIG. 13 is a schematic perspective view of a transfer station and transverse construct attachment system of the system of FIGS. 11 and 12.

As shown in FIGS. 11-14, the transfer station 204 can include a first bag conveyor 245 (broadly: a first liner conveyor 245) extending from the bag separating station 225 to the transverse construct attachment system 206. In one embodiment, the first bag conveyor 245 (e.g., a vacuum conveyor) can receive the separated bags 3 from the rollers 241, 243 and can move the bags in the first downstream direction M1. As shown in FIGS. 12-14, the first bag conveyor 245 includes two continuous belts 247 that cycle around the first bag conveyor 245 and through a tensioning device 246. Vacuum pressure can be applied to the top side of the belts 247 as they move along the bottom side of the first bag conveyor 245 (FIGS. 12 and 14), and the belts 247 can include apertures 249 so that the vacuum pressure can cause the bags 3 to be pressed against the undersides of the belts 247 when the bags 3 engage the belts. Accordingly, the bags 3 are carried by the vacuum pressure along with the belts 247 as they move along the underside of the first bag conveyor 245. The transfer station 204 and the first bag conveyor 245 could be omitted or could be otherwise arranged, shaped, positioned, and/or configured without departing from the disclosure. For example, the conveyor could be any suitable conveyor for transporting the bags 3 to the transverse construct attachment system 206.

As shown in FIGS. 11, 12, and 16, the transverse construct attachment system 206 can include a construct feeder 251, a construct conveyor 253 extending from the construct feeder 251 in the second machine direction M2 to the downstream end 205, and a second bag conveyor 255 (broadly: a second liner conveyor 255) extending over a portion of the construct conveyor 253. As shown in FIGS. 11-14, the bags 3 are received in the transverse construct attachment system 206 from the downstream end of the first bag conveyor 245 onto a transition or transfer plate 256 adjacent the upstream end of the second bag conveyor 255. In the illustrated embodiment, the transfer station 204 includes the transfer plate 256 and the second bag conveyor 255. As shown in FIGS. 13-15, the second bag conveyor 255 can be a vacuum conveyor that is similarly configured to the first bag conveyor 245, the second bag conveyor 255 having two continuous belts 257 that cycle around the first bag conveyor 255 and through a tensioning device 258. Each of the belts 257 includes a series of apertures 259 so that vacuum pressure applied to the top side of the belts 257 as they extend along the underside of the second bag conveyor 255 can cause the bags 3 to be pressed against the undersides of the belts 257 when the bags 3 engage the belts 257. As shown in FIG. 13, the second bag conveyor 255 extends in the second machine direction M2 from the first bag conveyor 245, and at least a portion of the second bag conveyor 255 is angled downwardly toward the construct conveyor 253. Accordingly, the bags 3 can be received by the second bag conveyor 255 from the transfer plate 256 and moved in the second machine direction M2 and downwardly toward the constructs 10 on the construct conveyor 153 along the underside of the second bag conveyor 255 as the belts 257 are moved around the second bag conveyor 255. The second bag conveyor 255 could be omitted or could be otherwise arranged, shaped, positioned, and/or configured without departing from the disclosure.

In one embodiment, the first bag conveyor 245 can be configured so that the vacuum generally is not applied to the belts 247 as they move over the rollers at the downstream end of the first bag conveyor 245. Accordingly, the bags 3 can be released from the belts 247 onto the transfer plate 256 as the belts 247 move over the end of the first bag conveyor 245. The second bag conveyor 255 can pick up the bags 3 from the transfer plate 256 and move the bags 3 in the second machine direction M2. In one embodiment, an actuator (not shown) (e.g., a puff of air or a pusher rod) can move the bag 3 on the transfer plate 256 to the second bag conveyor 255. Similarly to the first bag conveyor 245, the second bag conveyor 255 can be configured so that the vacuum generally is not applied to the belts 257 as they move over the rollers at the downstream end of the second bag conveyor 255. Accordingly, the bags 3 can be released from the second bag conveyor 255 onto a construct 10 moving along the construct conveyor 253 as described in more detail below.

In one embodiment, a construct feeder 251 (FIGS. 11 and 12) is positioned at an upstream end of the construct attachment system 206 and includes a stack 261 of constructs 10 (e.g., carton blanks 10) that are fed to the construct conveyor 253. As shown in FIGS. 11 and 12, the construct feeder 251 is a rotary type feeder that includes actuators 263 (e.g., suction cups or other suitable actuators) that each can remove a respective construct 10 from the stack 261, move the acquired construct to the construct conveyor 252, and release the construct onto the construct conveyor. As shown in FIG. 11, the actuators 263 can be mounted on a support 265 that is rotated to move the actuators 263 from the stack 261 to the construct conveyor 253. The construct feeder could comprise other types of feeders such as mechanisms that convey blanks 10 directly from a blank cutting station, or any other suitable types of feeders or other mechanisms without departing from the disclosure. For example, the carton feeder 251 could be replaced by a belt driven carton feeder in one embodiment.

As shown in FIGS. 11-13 and 16, the construct conveyor 253 includes two spaced apart primary lug belts or tracks 267 with lugs 269 for engaging the respective constructs 10 and conveying the constructs in the second machine direction M2. In the illustrated embodiment, the primary lug belts 267 can be endless belts, each with a plurality of the lugs 269 spaced along the respective belt. The construct conveyor 253 can receive the constructs 10 from the construct feeder 251 (FIGS. 11 and 12) and can move the series of constructs 10 from the carton feeder 251 under the second bag conveyor 255 to the downstream end 205 of the packaging system 200. In the illustrated embodiment, the construct conveyor 253 can include two guides 271 (e.g., construct guides) (FIGS. 12 and 16) extending along the construct conveyor 255 for supporting and guiding the constructs 10 as they are moved along the construct conveyor 255 by the primary lug belts 267. For example, the guides 271 can have a generally L-shaped cross-section so that a horizontal portion of the guides 271 can provide support for the outer ends of the constructs 10 and a vertical portion of the guides 271 can help retain the constructs 10 in position on the primary lug belts 267 (e.g., the guides 271 can help prevent the constructs 10 from shifting out of position in a direction that is non-parallel with the second machine direction M2).

As shown in FIGS. 13 and 16, the blank conveyor 253 can include one or more brushes 273 or other suitable features that can engage the constructs 10 as the primary lug belts 267 move the constructs 10 past the brushes 273. In the illustrated embodiment, the lugs 269 on each of the primary lug belts 267 can be spaced in the second machine direction M2 to form lug pockets for receiving the respective constructs 10. Accordingly, the construct feeder 251 can place the construct 10 in a lug pocket ahead of the upstream lugs 269 of the lug pocket as the primary lug belts 267 move the constructs 10 downstream in the second machine direction M2, the brushes 273 then can drag against the constructs 10 and push the constructs against the respectively adjacent lugs 269 so that, for example, the constructs 10 can be properly positioned for attachment to the bags 3 as described in more detail below. Subsequently, the lugs 269, now in engagement with a respective construct 10, can push the respective constructs 10 in the second machine direction M2 overcoming the resistance of the brushes 273. In one embodiment, the brushes 273 can extend along the majority of the length of the construct conveyor 253 to help retain the constructs 10 in position against the respective lugs 269 until the bags 3 are attached to the respective constructs 10 (e.g., downstream from the second bag conveyor 255). The construct conveyor 253 and any of the primary lug belts 267, the lugs 269, the guides 271, and/or the brushes 273 could be omitted or could be otherwise arranged, shaped, positioned, and/or configured without departing from the disclosure.

In one embodiment, as the construct conveyor 253 moves the constructs 10 toward the second bag conveyor 255, the constructs 10 can pass through a gluer assembly (not shown). The gluer assembly can include glue applicators (not shown) that apply an adhesive to the constructs 10 for attaching the bags 3 thereto. For example, the gluer assembly can apply glue strips G1 to the front panel 21 as shown in FIG. 4. Alternatively, the glue could be otherwise applied to the constructs 10 or the constructs 10 could be otherwise attached to the bags 3 without departing from the disclosure. For example, the constructs 10 could include pre-applied glue strips G1 in the stack 261, wherein the glue is a heat- or pressure-activated glue and the system could include a heat or pressure actuator for activating the glue when attaching the bag 3 to the construct 10.

In the illustrated embodiment, the construct conveyor 253 moves the constructs 10 under the second bag conveyor 255 so that each construct 10 receives a respective bag 3 as the respective construct 10 moves past the downstream end of the second bag conveyor 255 (e.g., the bag 3 can be positioned on the construct conveyor 253 so that the bag 3 at least partially extends over the construct 10) (FIGS. 13-15). The bags 3 can be carried on the respective constructs 10 as they are moved in the second machine direction M2 by the construct conveyor 253. In addition, the construct conveyor 253 can include two secondary lug belts 277 (FIGS. 11-13 and 16) extending from the downstream end of the second bag conveyor 255 to the downstream end 205 of the system 200. Similarly to the primary lug belts 267, the secondary lug belts 277 can be endless belts, each with a plurality of lugs 279 spaced along the respective belt. In the illustrated embodiment, the secondary lug belts 277 can be configured so that the lugs 279 are spaced slightly rearward (e.g., in the opposite direction to the second machine direction M2) from respective lugs 269 of the primary lug belts 267 (e.g., the lugs 269 pushing the construct 10 to which the bag 3 that will engage the lugs 279 will be attached). In addition, brushes 280 disposed downstream from the downstream end of the second bag conveyor 255 can engage the bags 3 overlaid on the respective constructs 10 and drag against the bags 3. In one embodiment, the drag on the bags 3 by the brushes 280 can slow or stop the movement of the bags 3 in the second machine direction M2 until the bags engage the lugs 279 of the secondary lug belts 277. The lugs 279 can push the bags 3 in the second machine direction M2 against the drag applied by the brushes 280 so that the bags 3 are aligned with and move along with the respective constructs 10. In one embodiment, the bags 3 can be positioned on the respective constructs 10 so that the upstream edges E1 (e.g., the top ends 7) of the bags 3 are spaced rearwardly with respect to the upstream edges E2 (e.g., top edges 70) of the respective constructs 10 (FIG. 16). Accordingly, the lugs 279 of the secondary lug belts 277 can engage the top edges E1 of the bags 3 while the lugs 269 of the primary lug belts 267 engage the top edges E2 of the respective constructs 10.

As shown in FIGS. 11 and 12, the system 200 can include a timing belt assembly 281 or other suitable feature for coordinating the first bag conveyor 245, the second bag conveyor 255, and/or the lug belts 267, 277 so that the bags 3 transported from the bag forming portion 201 are generally aligned with the respective constructs 10 on the construct attachment system 206. The lug belts 277 could be omitted or could be otherwise arranged, shaped, positioned, and/or configured without departing from the disclosure. For example, the second bag conveyor 255 and/or the secondary lug belts 277 could be replaced by a pusher arm (not shown) that moves the bags 3 in the second machine direction M2 to align the bags with the respective constructs 10.

As shown in FIGS. 11-13 and 16, two opposed nip rollers 283, 285 are disposed downstream from the downstream end of the second bag conveyor 255 for nipping the bags 3 to the respective constructs 10. In the illustrated embodiment, the combinations of the bags 3 overlaying the respective constructs 10 can pass between the nip rollers 283, 285 as the lug belts 267, 277 move the combinations in the second machine direction M2, and the nip rollers 283, 285 can press the bags 3 and the respective constructs 10 together with the adhesive (e.g., the glue strips G1) therebetween. Accordingly, in one embodiment, the pressure applied to the combination of the bags and constructs by the nip rollers 283, 285 can help the secure the bags 3 to the respective constructs 10 via the adhesive (e.g., by helping increase the contact surface between the bags and the constructs with the adhesive and/or activating the adhesive in the case that the adhesive is a pressure actuated adhesive). The nip rollers 283, 285 could be omitted or could be otherwise arranged, shaped, positioned, and/or configured without departing from the disclosure. For example, the construct conveyor 253 could include any suitable attachment features for attaching the bags 3 to the respective constructs 10.

As shown in FIGS. 11, 12, and 16, the construct conveyor 253 can move the attached bags 3 and constructs 10 from the nip rollers 283, 285 to the output conveyor 287 at the downstream end 205 of the system 200. Subsequently, the attached bags and constructs can be stacked and stored, moved to a folder gluer system for forming the packages 152, or otherwise further processed.

In one embodiment, the transverse direction of the construct attachment system 206 with respect to the direction of the bag forming portion 201 can facilitate attaching the bags 3 to the constructs 10 in the desired orientation (e.g., FIG. 4) without requiring reorientation of the bags 3 or the constructs 10. For example, the bags 3 can be formed by moving the web 101 in the first machine direction M1 while gradually folding the web 101 over itself in a direction that is transverse to the first machine direction M1, and it can be easier to move the constructs 10 in a direction that is parallel to their lateral axis L1 (FIG. 1). Accordingly, the system 200 has the advantage of forming the bags 3 in the desired direction and attaching the bags 3 to the constructs 10 while moving the constructs in the desired (e.g., transverse) direction while achieving the desired orientation of the bags 3 and constructs 10 when they are attached. The system 200 could be otherwise arranged, shaped, and/or configured without departing from the disclosure.

FIGS. 17-23 are views of a system 400 for partially forming combinations of constructs attached to liners in a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 17-23, the system 400 is similar to the construct attachment system 206 of the first embodiment with the bag forming portion 201 of the system 200 omitted. The system 400 (FIG. 17) includes a bag supply assembly 489 (FIG. 20) in place of the bag forming portion 201 and the bag conveyors 245, 255 of the system 200 in the first embodiment. In the illustrated embodiment, as shown in FIGS. 18-23, the constructs 10' can be similar or identical to the blanks as shown and described in the incorporated-by-reference '103 and '435 applications and the bags 3' can be similar to the liners and/or bags shown and described in the incorporated-by-reference '103 and '435 applications. In an alternative embodiment, the blanks 10' and/or the liners 3' could be similar or identical to the respective blanks 10 shown in FIGS. 1 and 4 and bags 3 shown in FIGS. 4-10 or any suitable construct or liner could be used with the system 400.

Figure 17:
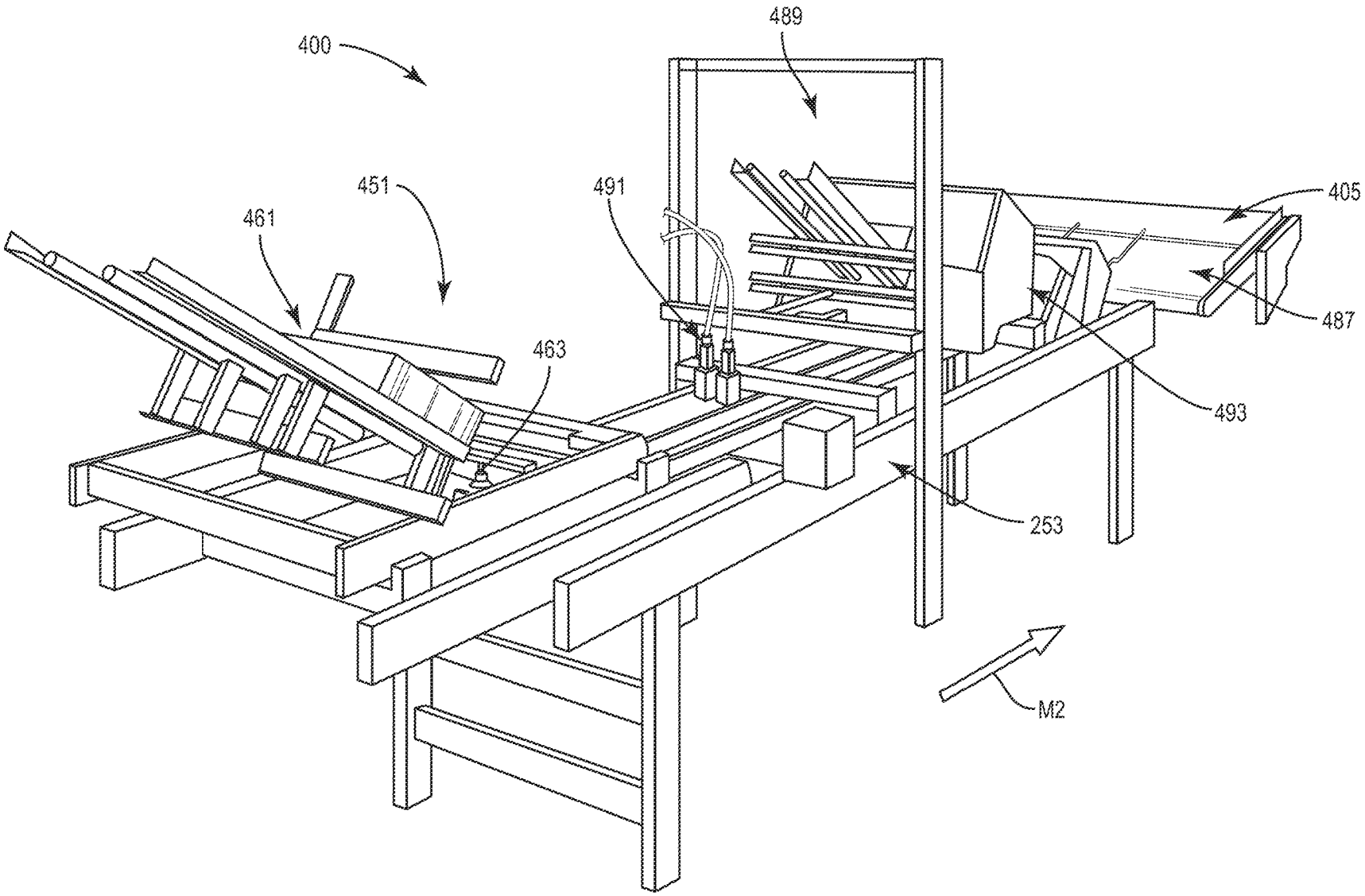
FIG. 17 is a schematic perspective view of a system and method for attaching a liner to a construct according to a second embodiment of the disclosure.
Figure 18:
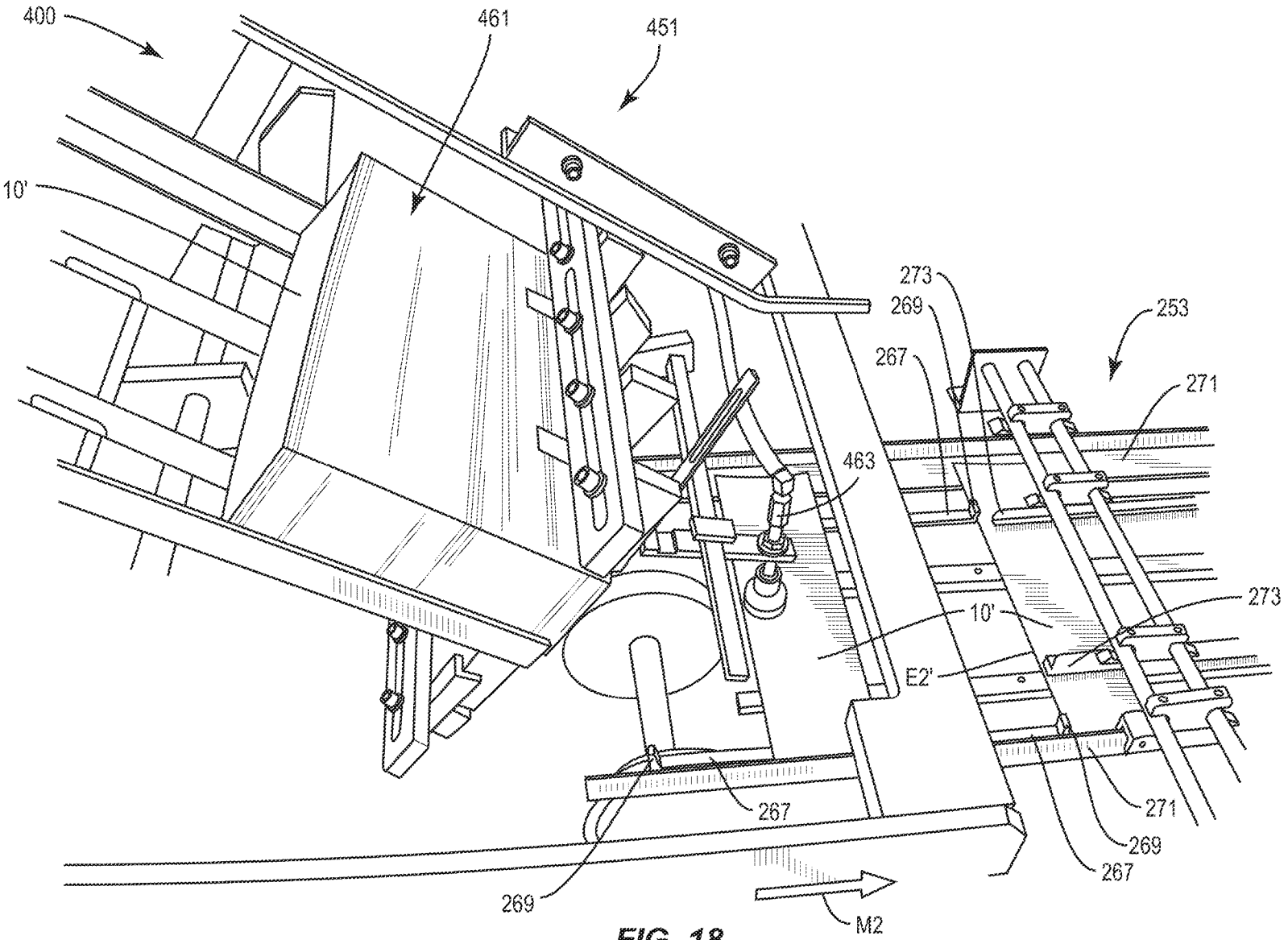
FIG. 18 is a schematic perspective view of a construct feeder and a portion of a construct conveyor of the system of FIG. 17.
Figure 19:
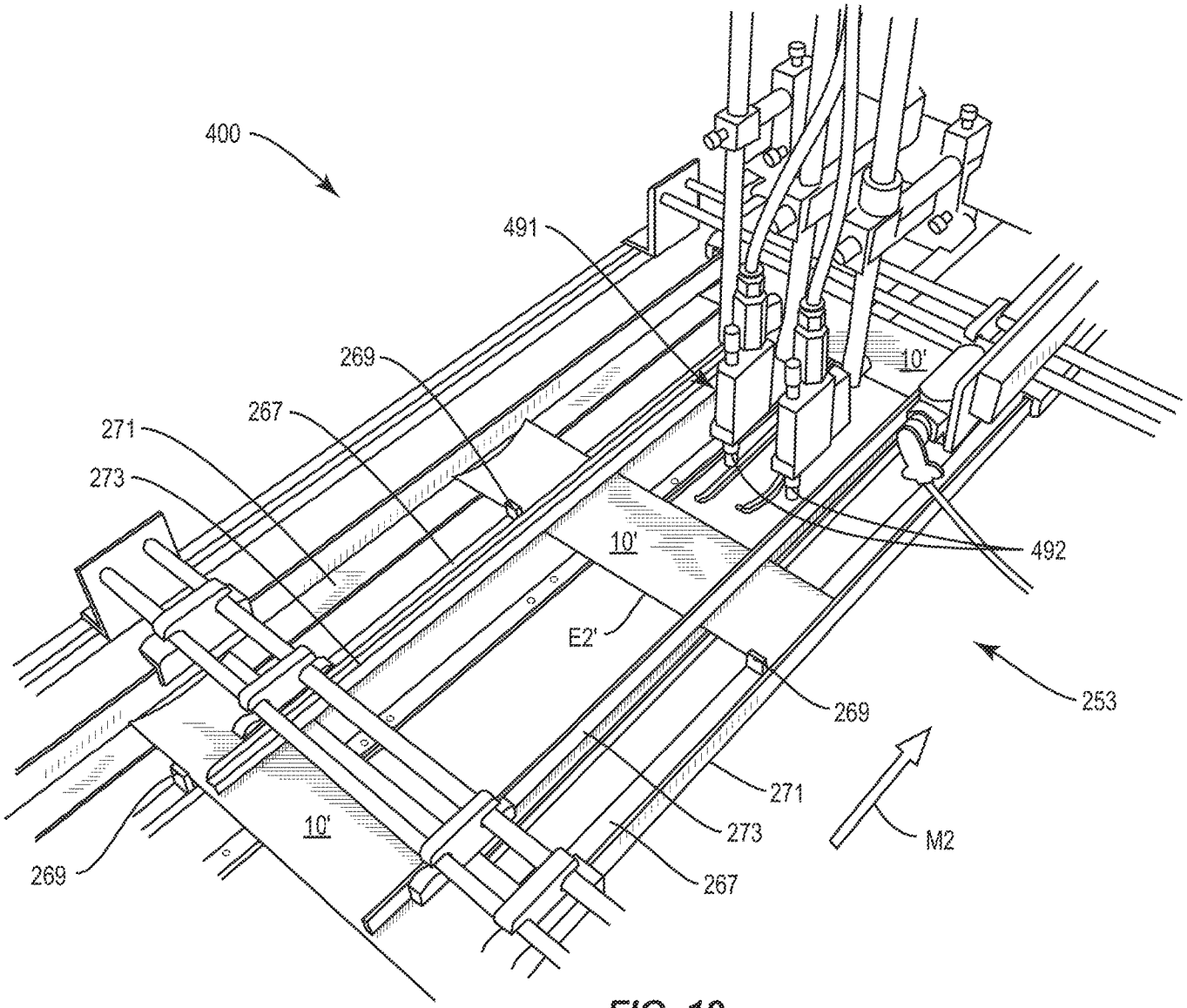
FIG. 19 is a schematic perspective view of a portion of the construct conveyor and an adhesive applicator of the system of FIG. 17.

As shown in FIGS. 17 and 18, the constructs 10' can be supplied in a stack 461 in a construct feeder 451 (e.g., a pick-and-place type feeder). In an alternative embodiment, the construct feeder 451 could be a rotary type feeder, which can be similar to the carton feeder 251 of the first embodiment or the construct feeder 451 could be any suitable feeder apparatus. In the Illustrated embodiment, an actuator arm 463 can acquire a construct 10' from the stack 461 (e.g., via a suction cup or other suitable feature), move the construct 10' to the construct conveyor 253, and release the constructs 10' onto the primary lug belts 267 of the construct conveyor 253. The constructs 10' can move on the primary lug belts 267 in the machine direction M2 while supported and guided by the primary guides 271 to a glue station 491 (FIGS. 17 and 19). As shown in FIGS. 18 and 19, the brushes 273 can engage the constructs 10' and apply a drag force on the constructs to at least partially restrain the constructs. In the illustrated embodiment, the drag force can cause the constructs 10' to slow or stop relative to the primary lug belts 267 until respective lugs 269 engage the upstream edge E2' of the respective construct 10'. The lugs 269 can push the constructs 10' in the machine direction M2, overcoming the drag force of the brushes 273.

Figure 20:
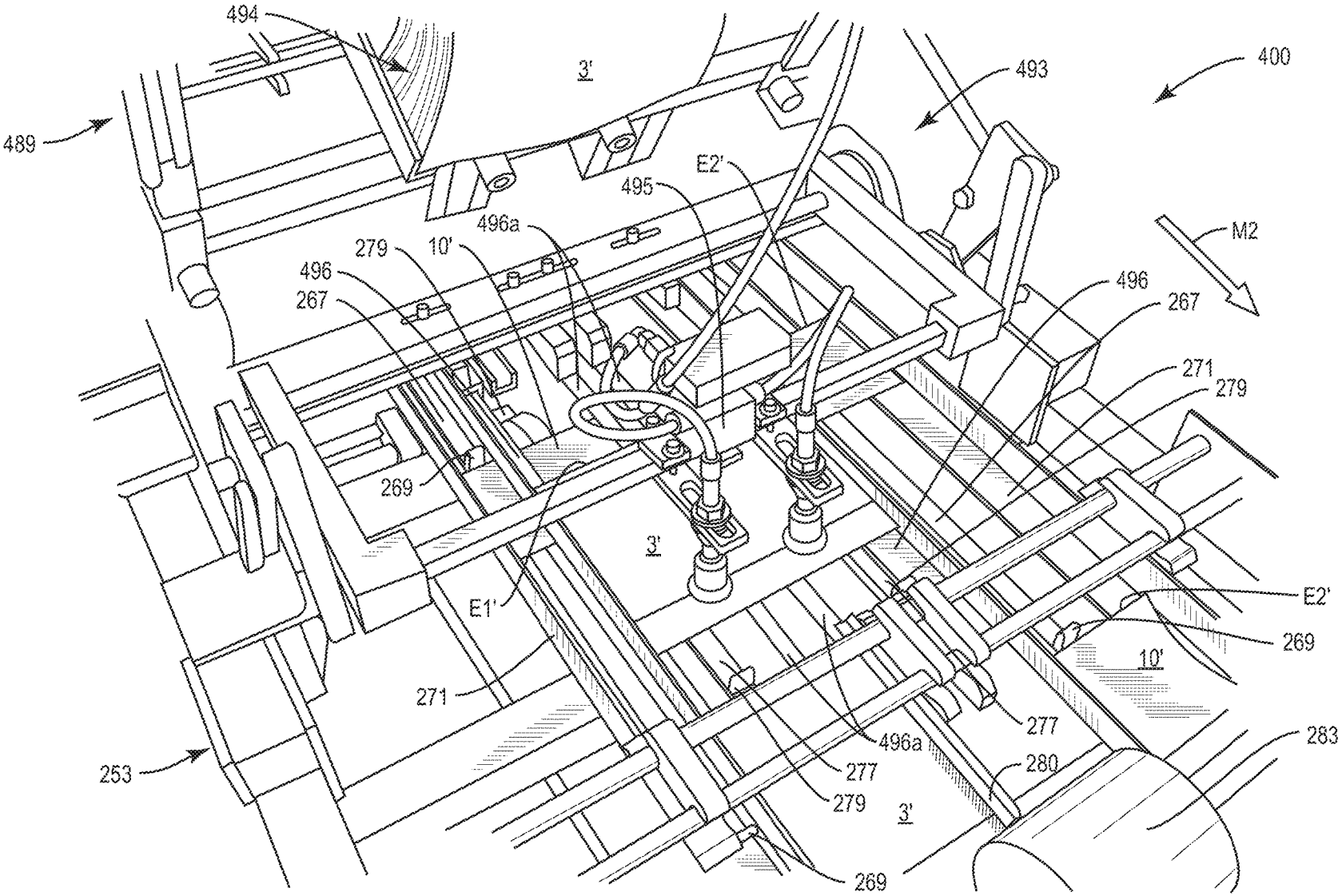
FIGS. 20-22 are schematic perspective views of a liner feeder, a pair of nip rollers, and another portion of the construct conveyor of the system of FIG. 17.
Figure 21:
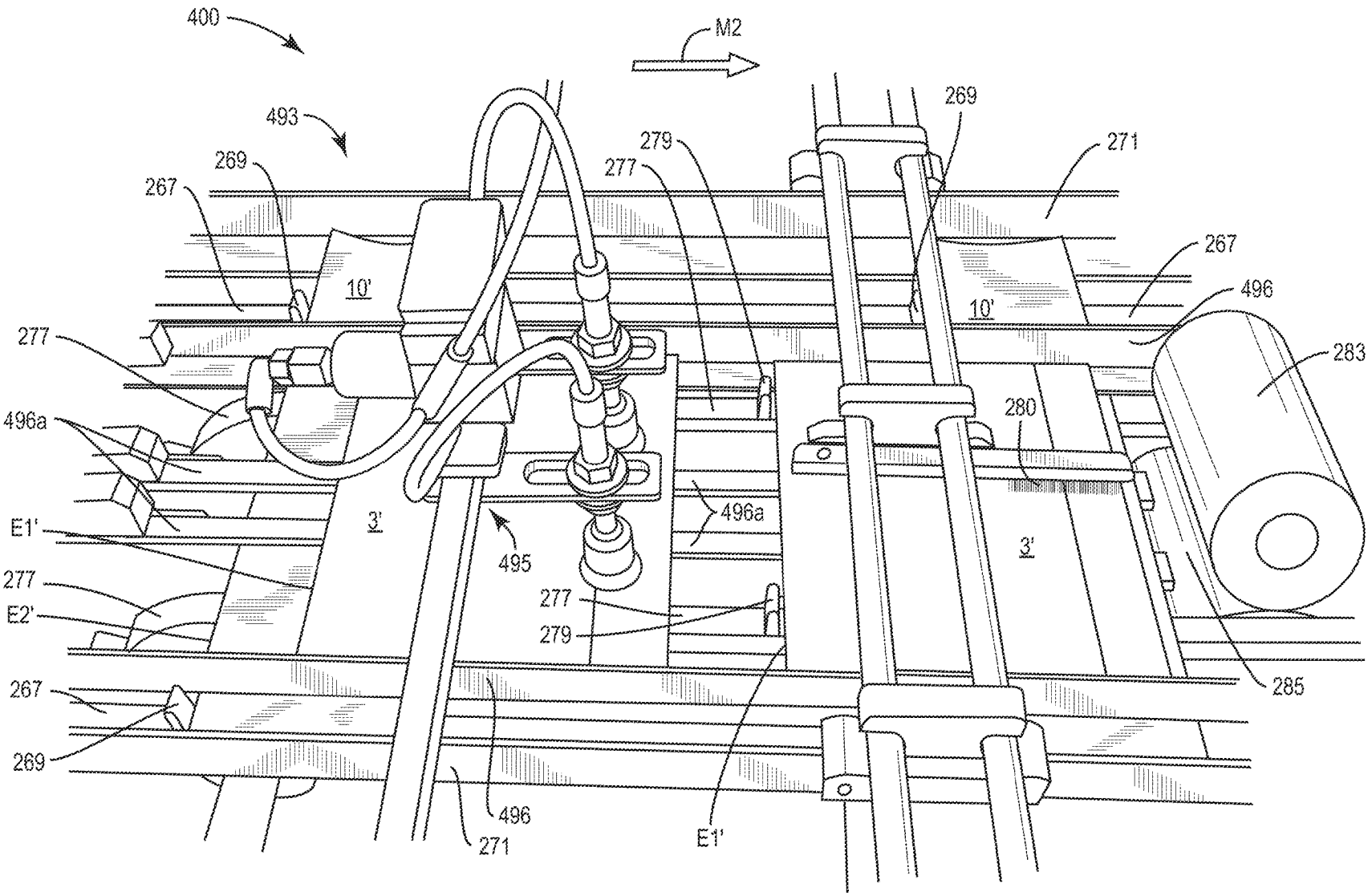
Figure 22:
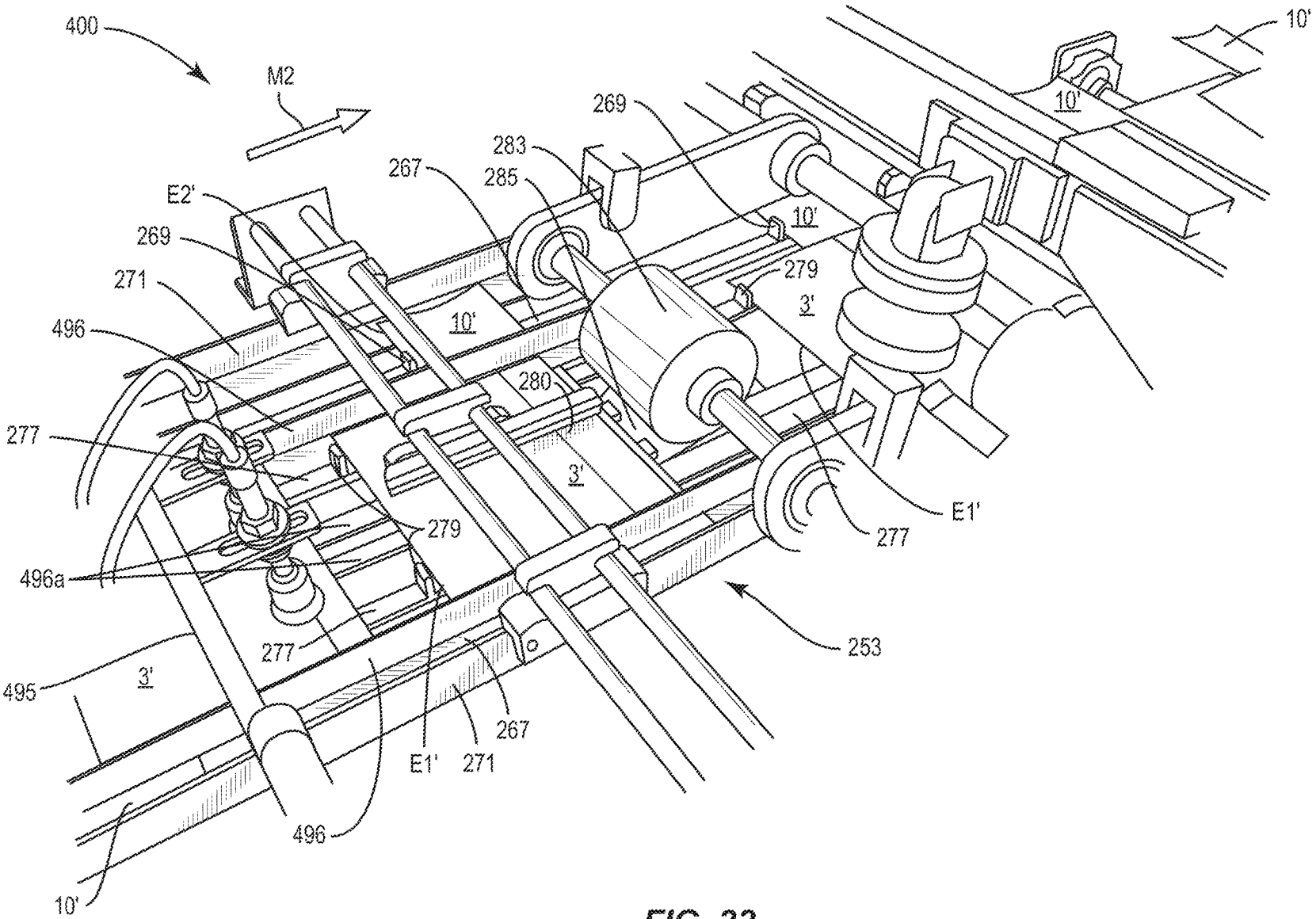

As shown in FIG. 19, the glue station 491 includes glue applicators 492 for applying adhesive (e.g., similar to the glue strips G1 shown in FIG. 4) to the constructs 10' for attaching the liners 3' to the constructs. As shown in FIG. 20, the constructs 10' can continue in the machine direction M2 under a liner feeder 493, which can include a stack 494 of liners 3' and an actuator 495 (e.g., a pick and place actuator). Alternatively, the liner feeder 493 could be any suitable liner feeder. In the illustrated embodiment, the actuator 495 can acquire a liner 3' from the stack 494 (e.g., via suction cups), move the liner 3' to the construct conveyor 253, and release the liner 3' onto two secondary guides 496 (e.g., liner guides) over a respective construct 10' (FIGS. 20 and 21). In the illustrated embodiment, the secondary guides 496 can be angle brackets (e.g., can have an L-shaped cross-section). The secondary guides 496 can be similar to the primary guides 271 and can be spaced inwardly and upwardly from the primary guides 271 so that the constructs 10' can pass under the secondary guides 496. In one embodiment, the secondary guides 496 can be spaced outwardly from the location of the adhesive applied by the glue station 491. Accordingly, the secondary guides 496 can support and guide the liners 3' over the constructs 10' to help prevent adhering of the liners 3' to the constructs 10' by the glue before the liners 3' are moved into position over the constructs 10' (e.g., are aligned for attachment to the respective constructs 10'). As shown in FIGS. 20-22, supplemental cantilever supports **496*a* can be included for further supporting the liners 3' over the constructs 10'. In the illustrated embodiment, the supplemental cantilever supports 496*a* can be supported at their upstream ends by brackets under the liner feeder 493. In one embodiment, the supplemental cantilever supports 496*a* can help hold the central portion of the liner 3' above (e.g., spaced from) the glue on the construct 10'** to help prevent adhering of the liner to the construct prior to aligning the liner with the construct.

In the illustrated embodiment, after being received on the construct conveyor 253, the liners 3' can move in the machine direction M2 (e.g., due to contact of the liners 3' with the secondary lug belts 277 and/or the respective constructs 10' and/or by engaging the lugs 279). As shown in FIGS. 20-22, the brush 280 can engage the liners 3' and apply a drag force on the liners so that the liners slow or stop relative to the respective constructs 10' and the secondary lug belts 277 until the lugs 279, which are spaced upstream from the lugs 269, engage the upstream edge E1' of the liner 3'. Accordingly, the liner 3' can be placed on the guides 496 ahead of the respective construct 10' (e.g., so that the upstream edge E1' of the liner 3' is downstream from the upstream edge E2' of the construct) and the brush 280 can at least partially restrain the liner 3' until the lugs 279 engage the liner (e.g., the construct 10' is moved under the liner 3' by the lugs 269 so that the edge E2' of the construct 10' moves downstream relative to the edge E1' of the liner until the lugs 279 engage the edge E1'). In the illustrated embodiment, the lugs 279 can overcome the drag force of the brush 280 on the liners 3' and the liners 3' can continue to be moved in the downstream direction M2 by the lugs 279. In one embodiment, the lugs 279 are spaced from the respective lugs 269 so that the liner 3' is generally aligned with the construct 10' when the edges E1', E2' are engaged by the respective lugs 279, 269. Accordingly, the liners 3' can be aligned and positioned for attachment to the respective constructs 10', which are moved in the downstream direction M2 by the lugs 269 toward the nip rollers 283, 285 while the secondary guides 496 and the cantilever supports **496*a* support the liners 3' above the construct 10'**.

Figure 23:
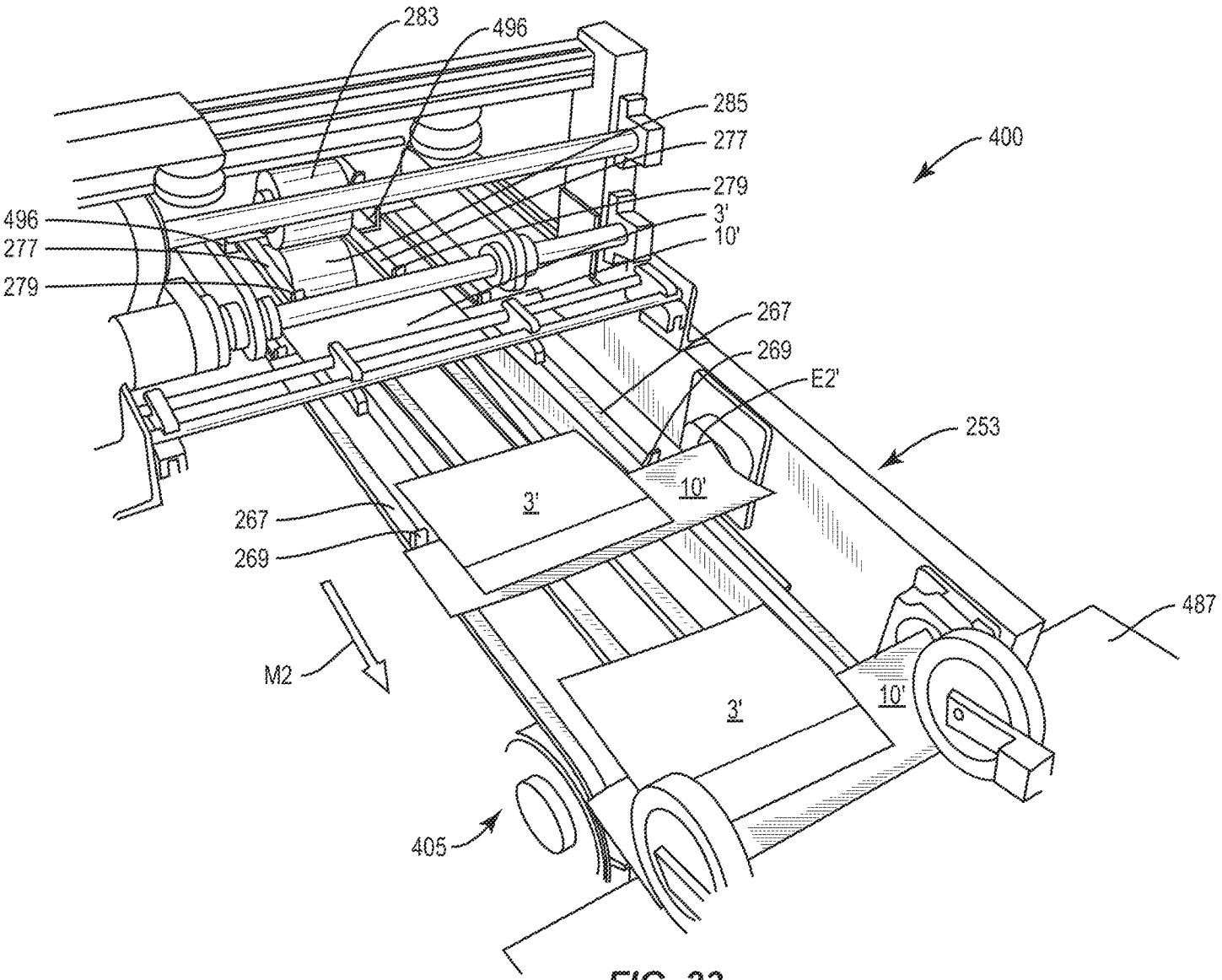
FIG. 23 is a schematic perspective view of the downstream end of the construct conveyor of the system of FIG. 17.

As shown in FIGS. 21-23, the overlapped and aligned liners 3' and constructs 10' can pass between the nip rollers 283, 285, which can press the liners 3' against the respective constructs 10' with the adhesive therebetween so that the adhesive secures the liners 3' to the respective constructs 10'. In the illustrated embodiment, the cantilever supports **496*a* can end upstream from the nip rollers 283, 285 (e.g., proximate to and downstream from the brush 280 where the liners 3' are aligned for attachment to the respective constructs 10'), and the secondary guides 496 can end proximate the nip rollers 283, 285 so that the liners 3' can more fully contact the respective constructs 10'. In one embodiment, the secondary guides 496 can be spaced outwardly from the nip rollers 283, 285. Since the liners 3' are now attached to the respective constructs 10' downstream from the nip rollers 283, 285, the liners 3' can move with the respectively attached constructs 10' as the constructs are pushed by the lugs 269. Accordingly, the downstream end of the secondary lug belts 277 can be just downstream from the nip rollers 283, 285. As shown in FIG. 23, the primary lug belts 267 can move the attached liners 3' and constructs 10' to the downstream end 405 of the system 400 to an output conveyor 487** for storage and/or further processing.

In one embodiment, the spacing between the lugs 279 on the respective secondary lug belts 277 (e.g., the lug pockets of the respective secondary lug belts 277) can allow for some variation in timing between the movement of the liners 3' in the liner feeder 493 and the constructs 10' on the primary lug belts 267 (e.g., the liner 3' can be placed ahead of the lugs 279 in the lug pocket so that the liner 3' is ahead of the desired alignment with the construct 10'). The secondary guides 496 and the cantilever supports **496*a* can help hold the liner 3' in the lug pocket above the construct 10' so that friction with the construct 10' and engagement with the adhesive on the construct 10' has a smaller effect on the movement of the liner 3'. The brush 280 further can slow or stop the liner 3' with respect to the construct 10' until the lugs 279 of the secondary lug belts 277 engage the liner 3' at which point the liner 3' can be aligned for attachment to the construct 10', which engages the lugs 269 of the primary lug belts 267. Subsequently, as the aligned liner 3' and construct 10' move downstream, the cantilever supports 496*a* end and the aligned liner 3' and construct 10' are nipped together between the nip rollers 283, 285. The system 400 could be otherwise arranged, shaped, and/or configured without departing from the disclosure. Additionally, any of the features of the system 400** could be omitted or could be otherwise arranged, shaped, positioned, and/or configured without departing from the disclosure.

Any of the features of the various embodiments of the disclosure can be combined with, replaced by, or otherwise configured with other features of other embodiments of the disclosure without departing from the scope of this disclosure. For example, the system 400 could be used with a liner framing system that is similar or identical to the bag forming system 201 of the first embodiment or could otherwise receive liners via a transfer station that is similar or identical to the transfer station 204 of the first embodiment. In another example, the secondary guides 496 and/or the cantilever supports 496*a* of the system 400 could be incorporated into the construct attachment system 206 of the first embodiment.

Generally, as described herein, liners can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such as various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of at least partially forming reinforced packages, the method comprising:

moving a construct in a machine direction on a construct conveyor, the construct conveyor comprising a primary lug belt with a primary lug and a secondary lug belt with a secondary lug, the construct being disposed on the primary lug belt, and the moving the construct comprising moving the primary lug belt in the machine direction so that the primary lug pushes the construct in the machine direction;

positioning a liner on the construct conveyor so that at least a portion of the liner extends over at least a portion of the construct; and moving the liner in the machine direction on the secondary lug belt of the construct conveyor, moving the liner comprises moving the secondary lug belt in the machine direction so that the secondary lug pushes the liner in the machine direction, wherein portions of the primary lug belt and the secondary lug belt extend below the liner and the construct during the moving the liner in the machine direction on the secondary lug belt.

2. The method of claim 1, wherein the positioning the liner comprising positioning the liner to be spaced downstream from the secondary lug and then aligning the liner for attachment to the construct.

3. The method of claim 2, wherein the aligning the liner comprises at least partially restraining the liner from moving in the in the machine direction until the secondary lug engages an upstream edge of the liner.

4. The method of claim 3, wherein the at least partially restraining the liner comprises engaging the liner with a brush that is stationary with respect to the secondary lug belt.

5. The method of claim 3, further comprising applying adhesive to the construct as the construct moves in the machine direction prior to the positioning the liner.

6. The method of claim 5, further comprising nipping the liner and the construct between nip rollers after the aligning the liner.

7. The method of claim 3, wherein the secondary lug is offset from the primary lug and the aligning the liner comprises engaging upstream edges of the construct and liner with the respective primary lug and secondary lug so that the upstream edges are spaced from one another by the offset between lugs when the liner is attached to the construct.

8. The method of claim 1, wherein the secondary lug is offset from the primary lug so that the liner is aligned for attachment to the construct when a first edge of the construct engages the primary lug and a second edge of the liner engages the secondary lug.

9. The method of claim 8, wherein the secondary lug is offset upstream from the primary lug.

10. The method of claim 1, wherein the moving the liner in the machine direction comprises supporting at least a portion of the liner on a liner guide that extends above the construct along at least a portion of the construct conveyor.

11. The method of claim 10, wherein the moving the liner in the machine direction comprises supporting at least a portion of the liner on a cantilever support that extends above the construct along at least a portion of the construct conveyor, the cantilever support supporting an inner portion of the liner and the liner guide supporting an outer portion of the liner.

12. The method of claim 11, further comprising applying adhesive to the construct prior to the positioning the liner and nipping the liner and the construct between nip rollers after the positioning the liner, the cantilever support extending to a point that is upstream from the nip rollers.

13. The method of claim 1, wherein the construct conveyor comprises two liner guides and two construct guides, the two liner guides are spaced inwardly and upwardly from the two construct guides, the moving the construct in the machine direction comprising supporting at least a portion of the construct on the two construct guides, and the moving the liner in the machine direction comprises supporting at least a portion of the liner on the two liner guides above the construct.

14. The method of claim 1, further comprising moving the liner on a first liner conveyor and a second liner conveyor prior to the positioning the liner, the first liner conveyor extending transverse to the machine direction and the second liner conveyor moving in the machine direction.

15. The method of claim 14, wherein the first liner conveyor receives the liner from a liner forming section, the second liner conveyor receives the liner from the first liner conveyor, and the positioning the liner on the construct conveyor comprises moving the liner from the second liner conveyor to the construct conveyor.

16. A system for at least partially forming reinforced packages, the system comprising:

a construct conveyor comprising a primary lug belt with a primary lug and a secondary lug belt with a secondary lug, the construct conveyor moving the primary lug belt and the secondary lug belt in a machine direction;

a construct positioned on the construct conveyor, the primary lug pushing the construct the machine direction; and a liner positioned on the construct conveyor and at least partially overlapping the construct, the secondary lug pushing the liner in the machine direction, wherein portions of the primary lug belt and the secondary lug belt extend below the construct and the liner.

17. The system of claim 16, wherein the secondary lug is spaced upstream from the primary lug, the primary lug engages an upstream edge of the construct, and the secondary lug engages an upstream edge of the liner when the liner is aligned for attachment to the construct.

18. The system of claim 16, wherein the construct conveyor further comprises a brush that engages the liner to at least partially restrain the liner until the liner is aligned for attachment to the construct, the secondary lug pushing the liner in the machine direction against the brush when the liner is aligned for attachment to the construct.

19. The system of claim 18, wherein the brush is stationary with respect to the secondary lug belt.

20. The system of claim 18, further comprising an adhesive applicator that applies adhesive to the construct as the primary lug pushes the construct in the machine direction, the adhesive applicator being upstream from the secondary lug belt.

21. The system of claim 20, further comprising a nip roller that nips the liner and the construct together when the liner is pushed by the secondary lug and the construct is pushed by the primary lug.

22. The system of claim 16, wherein the secondary lug is offset from the primary lug so that the liner is aligned for attachment to the construct when a first edge of the construct engages the primary lug and a second edge of the liner engages the secondary lug.

23. The system of claim 22, wherein the secondary lug is offset upstream from the primary lug.

24. The system of claim 16, wherein the construct conveyor further comprises a liner guide that supports at least a portion of the liner over the construct, the liner guide extending above the construct along at least a portion of the construct conveyor.

25. The system of claim 24, wherein the construct conveyor further comprises a cantilever support that supports at least an inner portion of the liner over the construct, the cantilever support extending above the construct along at least a portion of the construct conveyor, and the liner guide supporting an outer portion of the liner.

26. The system of claim 25, further comprising an adhesive applicator upstream from the secondary lug belt and a nip roller downstream from the cantilever support, wherein the adhesive applicator applies adhesive to the construct as the primary lug pushes the construct in the machine direction, and the nip roller nips the liner and the construct together when the liner is pushed by the secondary lug and the construct is pushed by the primary lug to at least partially adhere the liner to the construct.

27. The system of claim 16, wherein the construct conveyor comprises two liner guides and two construct guides, the two liner guides are spaced inwardly and upwardly from the two construct guides, the two construct guides support at least a portion of the construct as the primary lug pushes the construct in the machine direction, and two liner guides support at least a portion of the liner above the construct as the secondary lug pushes the liner in the machine direction.

28. The system of claim 16, further comprising a first liner conveyor and a second liner conveyor, the first liner conveyor extending transverse to the machine direction and the second liner conveyor extending in the machine direction, the first liner conveyor moving the liner to the second liner conveyor, and the second liner conveyor moving the liner from the first liner conveyor to the construct conveyor.

29. The system of claim 28, wherein the first liner conveyor receives the liner from a liner forming section.

* * * * *